US007572154B2

(12) United States Patent
Ichio et al.

(10) Patent No.: US 7,572,154 B2
(45) Date of Patent: Aug. 11, 2009

(54) JOINT CONNECTOR

(75) Inventors: Toshifumi Ichio, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/187,461

(22) Filed: Aug. 7, 2008

(65) Prior Publication Data

US 2009/0042445 A1 Feb. 12, 2009

(30) Foreign Application Priority Data

Aug. 10, 2007 (JP) ..... 2007-209313
Aug. 28, 2007 (JP) ..... 2007-221486
Aug. 28, 2007 (JP) ..... 2007-221505

(51) Int. Cl.
*H01R 13/502* (2006.01)

(52) U.S. Cl. ..... 439/701; 361/735

(58) Field of Classification Search ..... 439/626, 439/701, 717, 504.1, 638; 361/735, 790
See application file for complete search history.

(56) References Cited

U.S. PATENT DOCUMENTS 5,320,555 A * 6/1994 Okabe ..... 439/354
6,354,887 B2 * 3/2002 Maeda ..... 439/701
6,461,201 B1 10/2002 Maeda et al.
6,517,389 B2 * 2/2003 Sato ..... 439/701
6,573,453 B2 * 6/2003 Takada et al. ..... 174/72 A
2002/0002016 A1 1/2002 Sato et al.

FOREIGN PATENT DOCUMENTS

JP 3433797 5/2003

* cited by examiner

*Primary Examiner*—Neil Abrams
*Assistant Examiner*—Phuong Nguyen
(74) *Attorney, Agent, or Firm*—Gerald E. Hespos; Anthony J. Casella

(57) ABSTRACT

A joint connector (10) has sub-housings (S) (S1 to S6) that can be built up in plural levels. Projecting pieces (31) project on outer sides of the respective sub-housings (S) in directions intersecting a build-up direction (BUD) of the sub-housings (S) and define hand-push portions (13) by building up the sub-housings (S). The sub-housings (S) built up in levels are fit into the intermediate connector (20) by pushing the hand-push portions (13) towards the intermediate connector (20) so that terminal fittings (40) in the joint connector (10) are connected electrically with intermediate terminals (24) in the intermediate connector (20). Identifying projections (A) on the lower mating surfaces of the projecting pieces (31) enter identifying recesses (B) in the upper mating surfaces of adjacent projecting pieces (31) if the sub-housings (S) are built up properly.

11 Claims, 37 Drawing Sheets

JOINT CONNECTOR

BACKGROUND OF THE INVENTION

1. Field of the Invention

The invention relates to a joint connector including sub-housings arranged in a plurality of levels.

2. Description of the Related Art

Japanese Patent No. 3433797 relates to a joint connector including sub-housings arranged in a plurality of levels. The joint connector is constructed such that contacts and engaging portions are provided on side surfaces in the respective levels and are brought into contact with each other at proper assembled positions to assemble a plurality of sub-housings in alignment when the respective sub-housings are properly built up.

To reduce mold costs, the above-described joint connector uses common sub-housings formed with a plurality of contact portions and engaging portions on side surfaces. The contact portions and the engaging portions are cut off selectively according to the levels of the sub-housings in the process of building up the sub-housings.

However, the sub-housings built up in a plurality of levels is fit into a mating housing that has a fixed size. The inner walls of cavities for accommodating terminal fittings are thinned if the contact portions and the engaging portions are provided on the side surfaces of the sub-housings, and hence the connector has a reduced strength. There is also an increased burden on an operator due to the need to cut off the contact portions and the engaging portions and to dispose of the sub-housing if the contact portions and the engaging portions are cut off at wrong positions.

Thought has been given to forming retainer insertion openings in mating surfaces of the sub-housings and communicating with the cavities. Retainers could be inserted in the retainer insertion openings and could enter the cavities for locking the terminal fittings in the cavities as the sub-housings are built up. Specified clearances would have to be set between the opening edges of the retainer insertion openings and the retainers to reduce connection forces exerted at the time of building up the sub-housings. This construction would permit displacements of the built-up sub-housings along plane surfaces of the mating surfaces within the set ranges of the clearances. For example, a connecting operation could be performed by pushing only a bottommost sub-housing 100, as shown in FIG. 33. In this situation, the respective sub-housings are displaced gradually backward (left in FIG. 33) in a connecting direction from the lower levels towards the upper levels. As a result, the connecting operation could be completed before the uppermost sub-housing 101 reaches a proper connection position. Further, a lock projection 103 of a lock arm 102 on the uppermost housing 101 may not be fit into a lock hole 201, so that locking is not effected.

The sub-housings have cavities for accommodating terminal fittings, and an end of a wiring harness is connected with the terminal fittings. Each sub-housing often is mounted in an inspection apparatus after the terminal fittings are accommodated in the cavities, but before the sub-housings are built up. An electrical connection test for the terminal fittings then is conducted by bringing conducting probes of the inspection apparatus into contact with the terminal fittings. This electrical connection test can determine if the terminal fittings are connected with a correct wiring harness, but cannot determine whether the terminal fittings are accommodated in proper sub-housings. The wiring harness could be laid incorrectly after the sub-housings are built up if the terminal fittings are accommodated in the wrong sub-housings.

The invention was developed in view of the above situation and an object thereof is to facilitate a building-up operation by preventing an erroneous buildup of sub-housings without causing a reduction in strength.

SUMMARY OF THE INVENTION

The invention relates to a joint connector with sub-housings that can be built up in a plurality of levels. Cavities are provided in the respective sub-housings and are capable of accommodating terminal fittings. One or more projecting pieces are provided on outer sides of the respective sub-housings, and project in a direction intersecting a build-up direction of the sub-housings. One or more identifying projections are provided on mating surfaces at one side of the respective projecting pieces, and one or more identifying recesses are provided in mating surfaces at the other side for receiving the identifying projections therein if the sub-housings are built up properly.

The projecting pieces preferably form a hand-push portion by building up the sub-housings. The sub-housings that have been built up in a plurality of levels are fit into a mating housing by pushing the hand-push portion towards the mating housing. Thus, the terminal fittings are connected electrically with corresponding mating terminal fittings in the mating housing.

The identifying projections are received into the identifying recesses if the sub-housings are built up properly. Conversely, the sub-housings cannot be built up in an erroneous arrangement. Further, the identifying projections and the identifying recesses utilize the existing hand-push portion. Thus, the joint connector can be made smaller as compared with the case where the identifying projections and the identifying recesses are provided separately. Furthermore, the projecting pieces of the hand-push portion are provided on the outer sides of the sub-housings. Thus, the inner walls of the cavities need not be thinned and, hence, the joint connector is strong.

The identifying projections and the identifying recesses may be aligned substantially with each other in the build-up direction in a properly built-up state of the sub-housings. The identifying recesses may be holes that conform to the cross-sectional shapes of the identifying projections. Projecting ends of the identifying projections may interfere with the opening edges of the identifying recesses due to different cross-section shapes and/or different orientations of the cross-section shapes and the holes unless the sub-housings are built up properly. Conversely, the identifying projections are received in the identifying recesses when the cross-sectional shapes and/or orientations of the identifying projections conform to the cross-sectional shapes and/or orientations of the identifying recesses. Thus, an erroneous buildup of the sub-housings can be prevented. For example, a pair of identifying projections and a pair of identifying recesses can be arranged for each sub-housing while being spaced at specified intervals in the width direction. These identifying projections and identifying recesses can be aligned in the build-up direction with the intervals between the identifying projections and between the identifying recesses fixed. Therefore, there is no likelihood of enlarging the joint connector in the width direction.

Two projecting pieces may be provided for each sub-housing. Additionally, two identifying projections and two identifying recesses may be provided respectively at specified intervals. The projecting ends of the identifying projections may interfere with the mating surface at the other side due to different intervals between the identifying projections and between the identifying recesses if the sub-housings are not built up properly. Conversely, the identifying projections are received in the identifying recesses when the interval between the identifying projections and the identifying recesses coincide. Thus, an erroneous buildup of the sub-housings can be prevented.

The identifying recesses in the sub-housing in the bottommost level may be set to receive the identifying projections on all of the sub-housings located above the bottommost level. Thus, the sub-housing in the bottommost level can be used as a common sub-housing even if the number of the levels of the sub-housings is changed.

The projecting pieces may be formed to project laterally at rear parts of the sub-housings. The hand-push portion is formed at the rear part of the joint connector. Thus, a pushing operation can be performed easily upon connecting the joint connector with the mating housing. Accordingly, an erroneous build-up of the sub-housings is prevented easily without reducing the strength.

One or more retainer insertion openings may be formed in mating surfaces at one side of the respective sub-housings and communicate with the insides of the respective cavities. One or more retainers project from mating surfaces at the other side and are insertable into the cavities through the retainer insertion openings to lock and retain the terminal fittings in the cavities as the sub-housings are built up. Ribs are provided between the opening edges of the retainer insertion openings and the retainers substantially facing the opening edges for preventing the properly built-up sub-housings from being displaced along directions lying in a plane of the mating surfaces. Accordingly, displacements of built-up sub-housings are prevented while holding terminal fittings in cavities. For example, even if the connecting operation is performed by pushing only the sub-housing in the bottommost level towards the mating housing, there is no likelihood that the connecting operation is completed before the sub-housing in the uppermost level reaches a proper connection position.

The sub-housing at one end in a build-up direction of the sub-housings may include at least one lock arm for engaging a lock of the mating housing to hold the joint connector and the mating housing together. The lock arm is assured of engaging the lock even if the lock arm is on the uppermost sub-housing and the connecting operation is performed by pushing only the bottommost sub-housing.

The ribs preferably are formed at or near the base ends of the retainers and may contact the opening edges of the retainer insertion openings as the retainers are inserted into the retainer insertion openings. Specified clearances may be set over substantially the entire periphery between the opening edges of the retainer insertion openings and the retainers facing the opening edges before the ribs contact the opening edges of the retainer insertion openings. According to such a construction, small connecting forces are sufficient before the ribs contact the opening edges of the retainer insertion openings while building up the sub-housings.

Each rib may include a slanted guide surface for sliding in contact with the opening edge of the retainer insertion opening to guide the sub-housing towards a proper position. A holding portion preferably extends substantially in a build-up direction from the slanted guide surface, and contacts the opening edge of the retainer insertion opening to hold the sub-housing at the proper position. Thus, the slanted guide surfaces guide the sub-housings to the proper positions and the holding portions hold the sub-housings at the proper positions following the guiding operation so that the sub-housings cannot be displaced while terminal fittings are held in cavities.

Guide pieces preferably project from the sub-housings and are insertable into respective guide grooves in a mating housing to guide a connecting operation of the housings when the built up sub-housings are connected with the mating housing. An electrical connection test can be conducted to determine whether the terminal fittings are connected with a correct wiring harness and whether the terminal fittings are arranged properly within the respective sub-housing. The test is conducted by mounting the sub-housing before being built up in an inspection apparatus and bringing conducting probes of the inspection apparatus into contact with the terminal fittings. Cutouts are formed near leading ends of the guide pieces in different arrangements and/or different shapes for the respective sub-housing. A detectable portion identifies the type of sub-housing by causing a detector provided separately from the conducting probes to detect the presence or absence of the cutout and/or a different shape of the cutout. Accordingly, improved operability is achieved by enabling a wiring harness to be laid correctly after sub-housings are built up.

The detector may be a contact sensor. The sensor will not be contact if the cutout is formed, but will be contacted by the leading end of the guide piece if no cutout is formed. Accordingly, the contact sensor detects the presence or absence of the cutout.

The detector and the one or more cutouts may be provided on each of the sub-housings at intermediate positions and excluding those located at the opposite ends in a build-up direction. Normally, the sub-housings at intermediate positions are identically shaped. Thus, it could be that terminal fittings are accommodated in wrong sub-housings. Accordingly, it is not necessary to inspect all of the built-up sub-housings and inspection efficiency is improved by inspecting only the sub-housings at the intermediate positions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
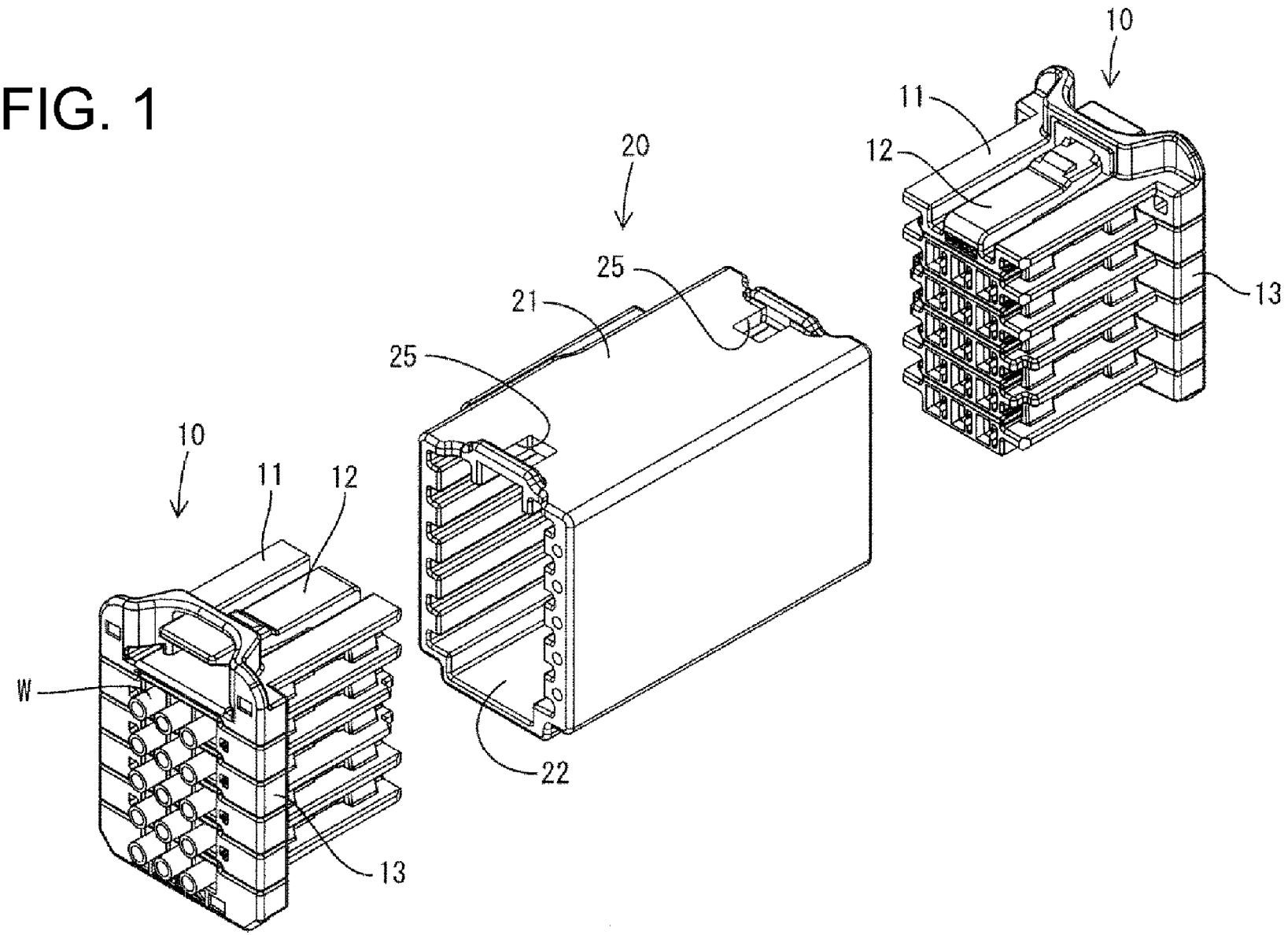
FIG. 1 is a perspective view showing a state before joint connectors and an intermediate connector are connected in a first embodiment.
Figure 2:
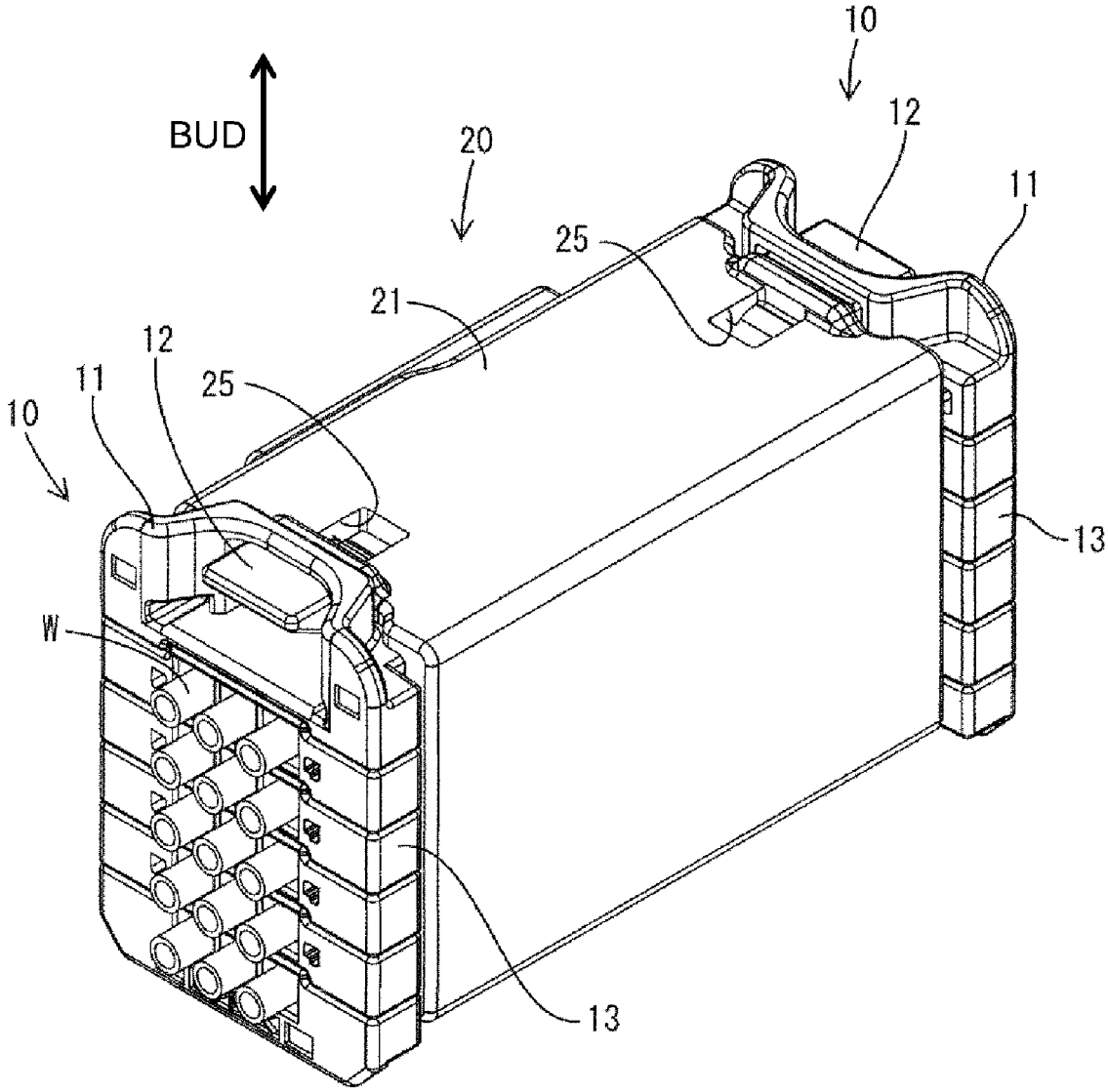
FIG. 2 is a perspective view showing a state after the joint connectors and the intermediate connector are connected.
Figure 3:
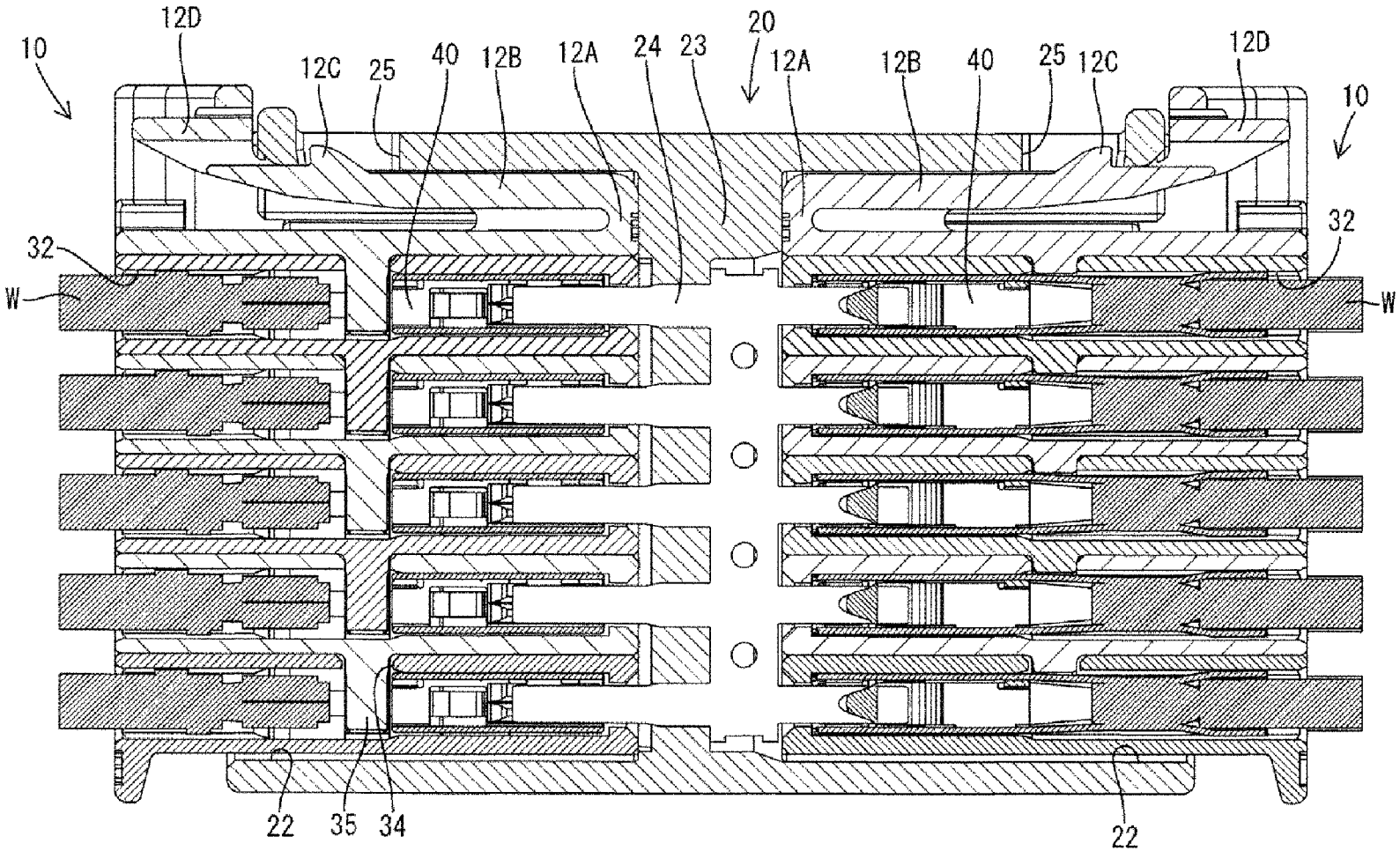
FIG. 3 is a vertical section showing the state after the joint connectors and the intermediate connector are connected.
Figure 4:
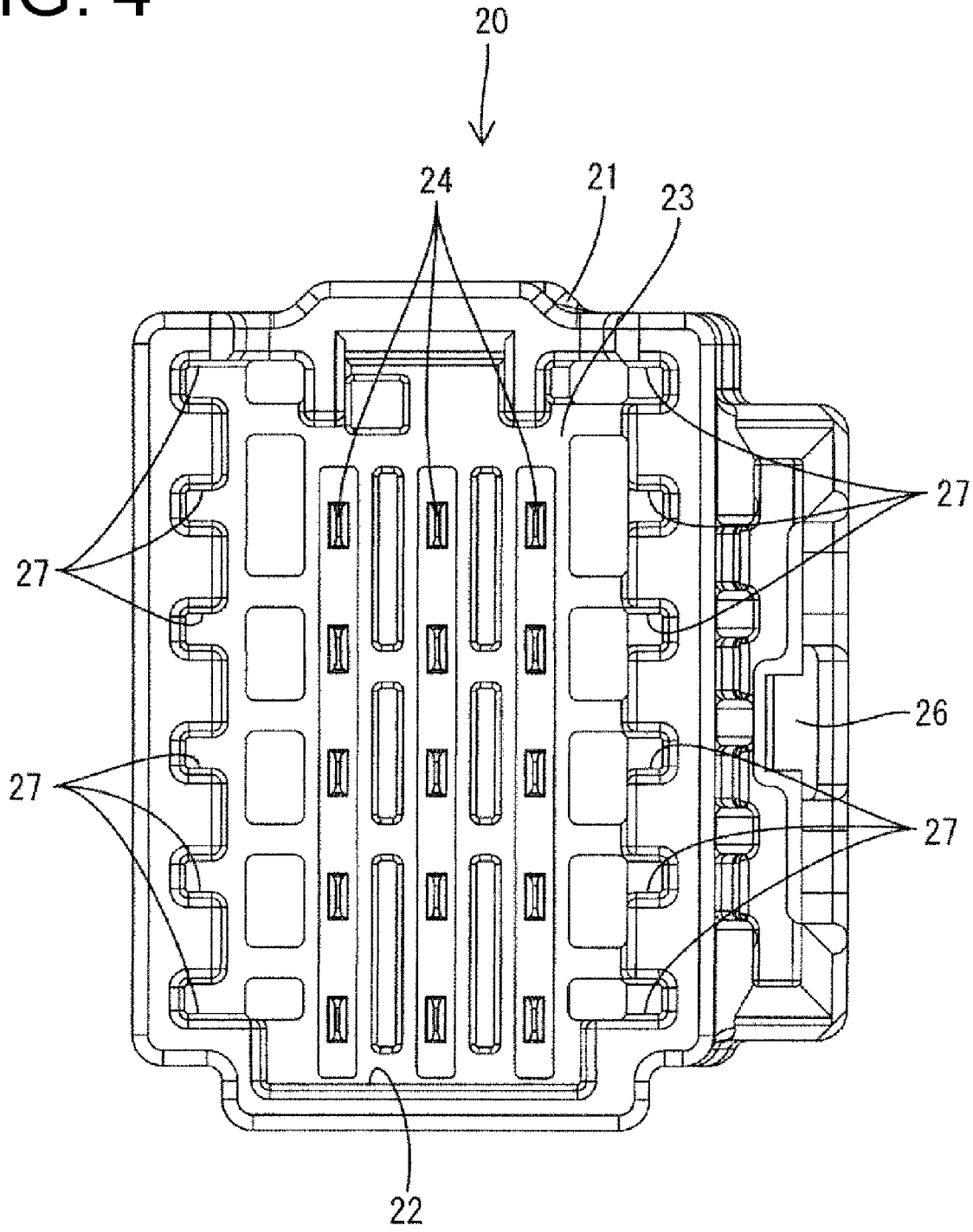
FIG. 4 is a front view of the intermediate connector.

Joint connectors according to the invention are identified by the numeral 10 in FIGS. 1 through 3. The joint connectors 10 are configured to fit into opposite ends of an intermediate connector 20. The ends of the joint connectors 10 that are to be connected with the intermediate connector are referred to herein as the front ends.

Two hand-push portions 13 are formed near the rear end of each joint connector 10 and are to be pushed for fitting the joint connector 10 into the intermediate connector 20. The hand-push portions 13 project towards the opposite widthwise sides and are set to face the opening edge of a fitting recess 22 of the intermediate connector 20 when the two connectors 10, 20 are connected properly, as shown in FIG. 2.

Each joint connector 10 includes a built-up housing 11 made e.g. of synthetic resin and including first through sixth sub-housings S1, S2, S3, S4, S5 and S6, which are referred to collectively herein as the sub-housings S. The sub-housings S are arranged along a built up direction BUD, and a direction towards the sub-housing S1 is referred to as the upward direction based on the build-up direction BUD of the respective sub-housings S.

A lock arm 12 is formed on the first sub-housing S1 for holding the two connectors 10, 20 in a properly connected state. The lock arm 12 includes a base 12A that projects up from the front end of the upper surface of the first sub-housing S1 and an arm 12B that is cantilevered backward from the base 12A. The arm 12B is resiliently deformable up and down. An unlocking portion 12C is formed near the rear end of the arm 12B for unlocking the lock arm 12. Further, a lock 12D projects up at a position of the arm 12B slightly before the unlocking portion 12C.

Figure 5:
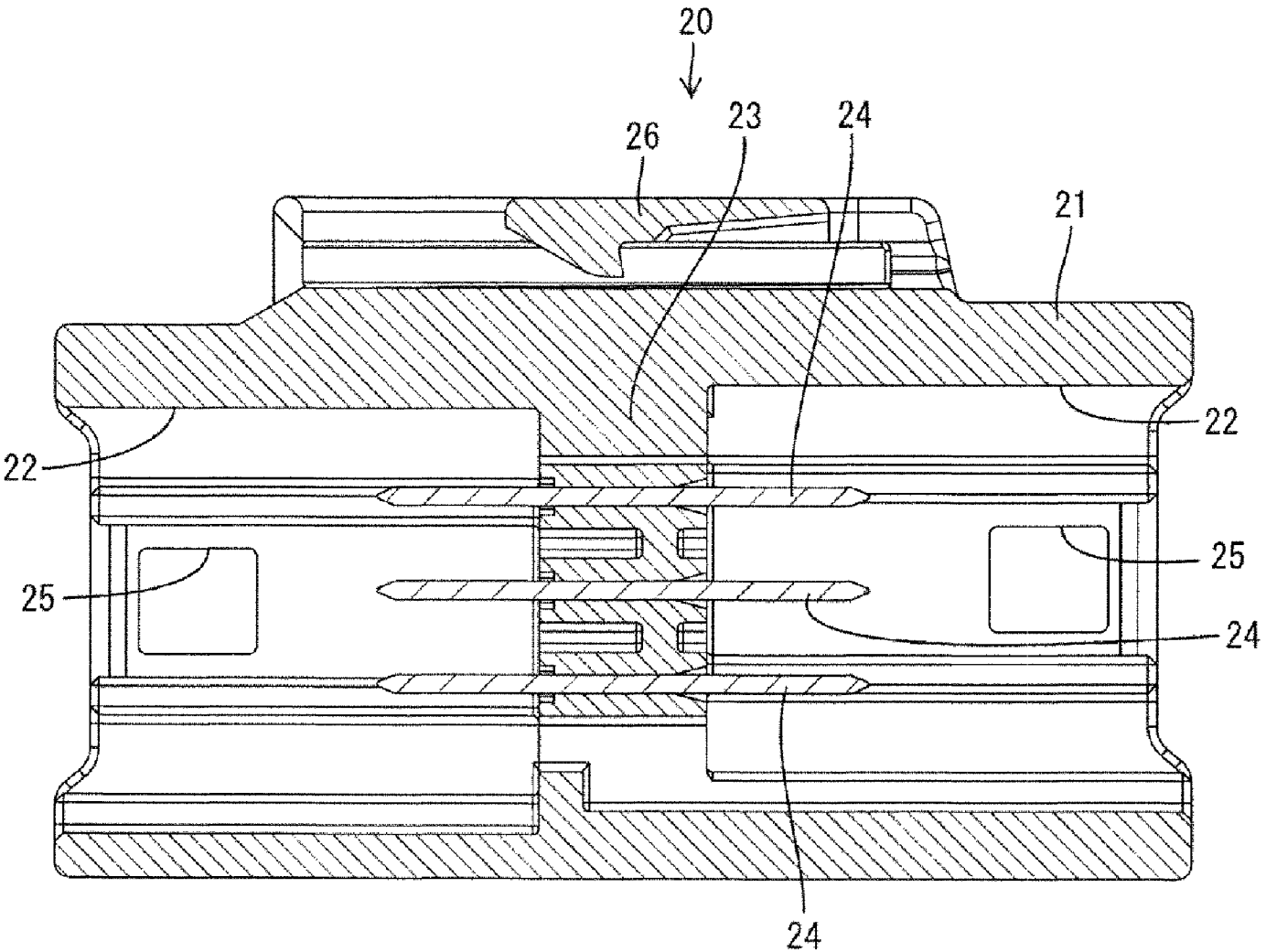
FIG. 5 is a horizontal section of the intermediate connector.

The intermediate connector 20 includes an intermediate housing 21 made e.g. of synthetic resin. The intermediate housing 21 has two fitting recesses 22 that open respectively to the front and rear ends and an intermediate wall 23 is formed in the intermediate housing 21 to partition the both fitting recesses 22. Intermediate terminals 24 are pressed through the intermediate wall 23 from one fitting recess 22 towards the other fitting recess 22. As shown in FIG. 5, three intermediate terminals 24 are arranged at specified intervals in the width direction. Further, as shown in FIG. 3, five tab-shaped terminals are arranged vertically in conformity with the respective terminal fittings 40 in the second to sixth sub-housings S2, S6 at both sides in each intermediate terminal 24, and the vertically adjacent tab-shaped terminals are united by being connected with each other. It should be understood that the fitting recesses 22 may have any relative orientation, e.g. they may be arranged to open to substantially opposite sides of the intermediate connector 20 or they may be arranged at an angle to each other to form an angled intermediate connector 20 connecting wires/wire harnesses under the respective angle.

Two lock holes 25 are formed in the upper surface of the intermediate housing 21 and penetrate the fitting recesses 22 in inward and outward directions. The lock projections 12D fit into the lock holes 25 from the insides of the fitting recesses 22 as the joint connectors 10 are fit into the fitting recesses 22. The lock projections 12D engage the inner peripheral surfaces of the lock holes 25 to hold the two properly connected connectors 10, 20 together. A fixing portion 26 is provided on a side surface of the intermediate housing 21 and is fixed to a mounting stay (not shown) on a device.

Guide grooves 27 in the opposite widthwise sides of the inner peripheral surface of the fitting recess 22 of the intermediate connector 21 and extend in forward and backward directions. The guide grooves 27 are formed in conformity with the respective sub-housings S and receive guide pieces 36 that project from the opposite widthwise sides of the main bodies 30 for guiding the connecting operation of the two connectors 10, 20.

Figure 6:
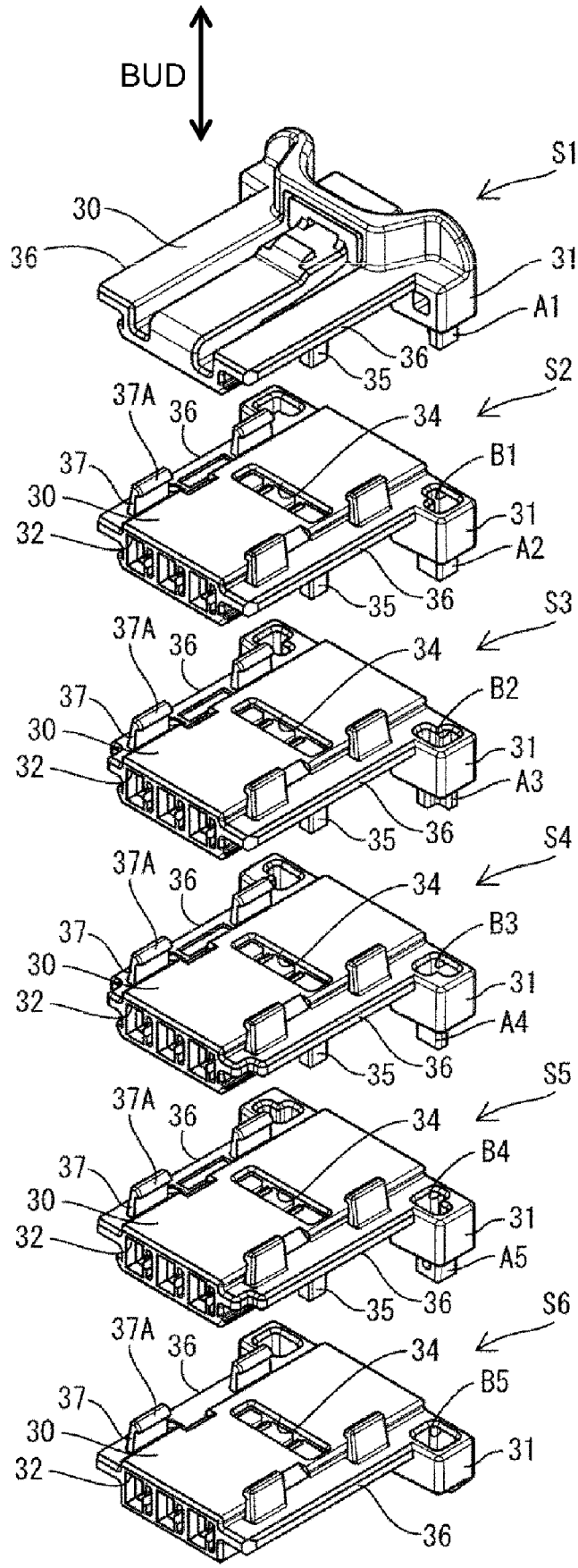
FIG. 6 is a perspective view showing a state before sub-housings are built up.

As shown in FIG. 6, each sub-housing S includes a plate-like main body 30 and projecting pieces 31 project laterally out from the opposite widthwise sides at a rear part of the main body 30. Three cavities 32 are arranged in the width direction of each of the second to sixth sub-housings S2 to S6 and penetrate the second to sixth sub-housings S2 to S6 in forward and backward directions. Terminal fittings 40 are accommodated into the cavities 32 from behind. A locking lance 33 is formed at a side wall of each cavity 32 and is resiliently deformable in a direction intersecting a direction of insertion of the terminal fitting 40 into the cavity 32. The locking lance 33 engages the terminal fitting 40 from the side to retain the terminal fitting 40 in the cavity 40.

A retainer insertion opening 34 penetrates the upper surface of each of the second to sixth sub-housings S2 to S6 and communicates with the three cavities 32. Retainers 35 project from the lower surface of the adjacent housing S1-S5 and enter the corresponding cavities 32 through the retainer insertion opening 34 when each sub-housing S is placed properly. The retainers 35 engage the rear ends of the terminal fittings 40 that have been inserted to proper positions in the cavities 32 to hold the terminal fittings 40 in the cavities 32. Thus, the terminal fittings 40 are held doubly by the locking lances 33 and the retainers 35.

Clearances are set between the side walls of the retainers 35 and the opening edges of the retainer insertion openings 34 to reduce connection forces exerted upon building up the sub-housings S. However, the clearances enable the sub-housings S to be displaced in forward and backward directions. As a result, if the two connectors 10, 20 are connected, for example, by pushing only the sixth sub-housing S6 in the bottommost level, the sub-housings towards the uppermost level could be displaced more backward and locking by the lock arm 12 in the first sub-housing S1 in the uppermost level could not be effected. As a countermeasure, ribs 35A are provided near the base ends of the retainers 35 for preventing backlash between the retainers 35 and the opening edge of the retainer insertion opening 34.

Guide pieces 36 project in the width direction from the opposite widthwise sides of the main body 30. These guide pieces 36 are inserted slidably into guide grooves 27 formed in the opposite widthwise sides of the inner peripheral surface of the fitting recess 22 of the intermediate housing 21 for guiding the connecting operation of the two housings 10, 20. Cutouts 36A are formed near the front edges of the guide pieces 36 for identifying the type of the sub-housing S in an inspection process before each sub-housing S is built up in the built up direction BUD. This inspection process detects the cutouts 36A to determine whether a wiring harness W is connected properly with the respective terminal fittings 40 and uses probes (not shown) to determine whether the terminal fittings 40 connected with the wiring harness W are accommodated in a correct sub-housing S.

Figure 8:
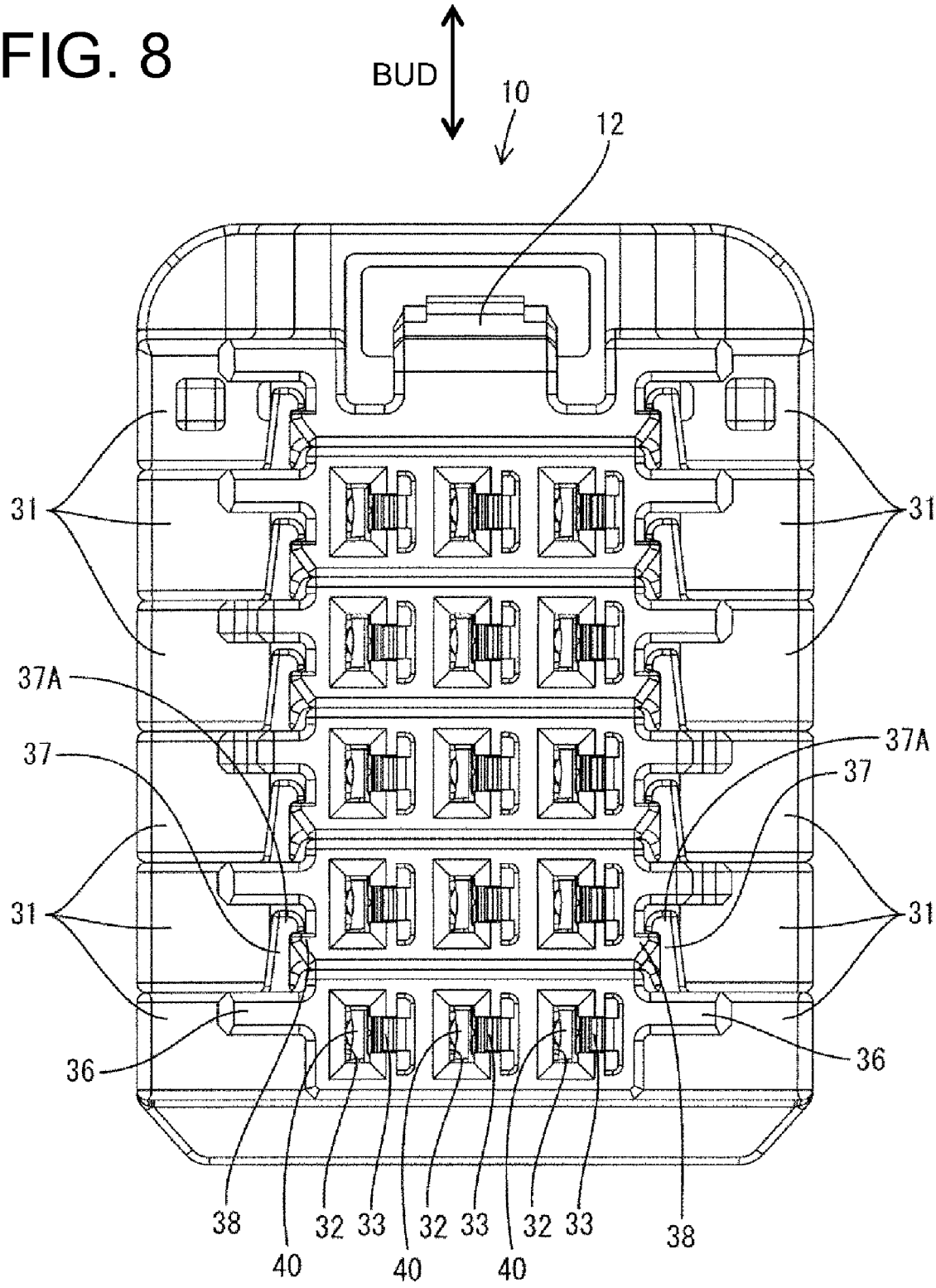
FIG. 8 is a front view showing the state before the sub-housings are built up.
Figure 9:
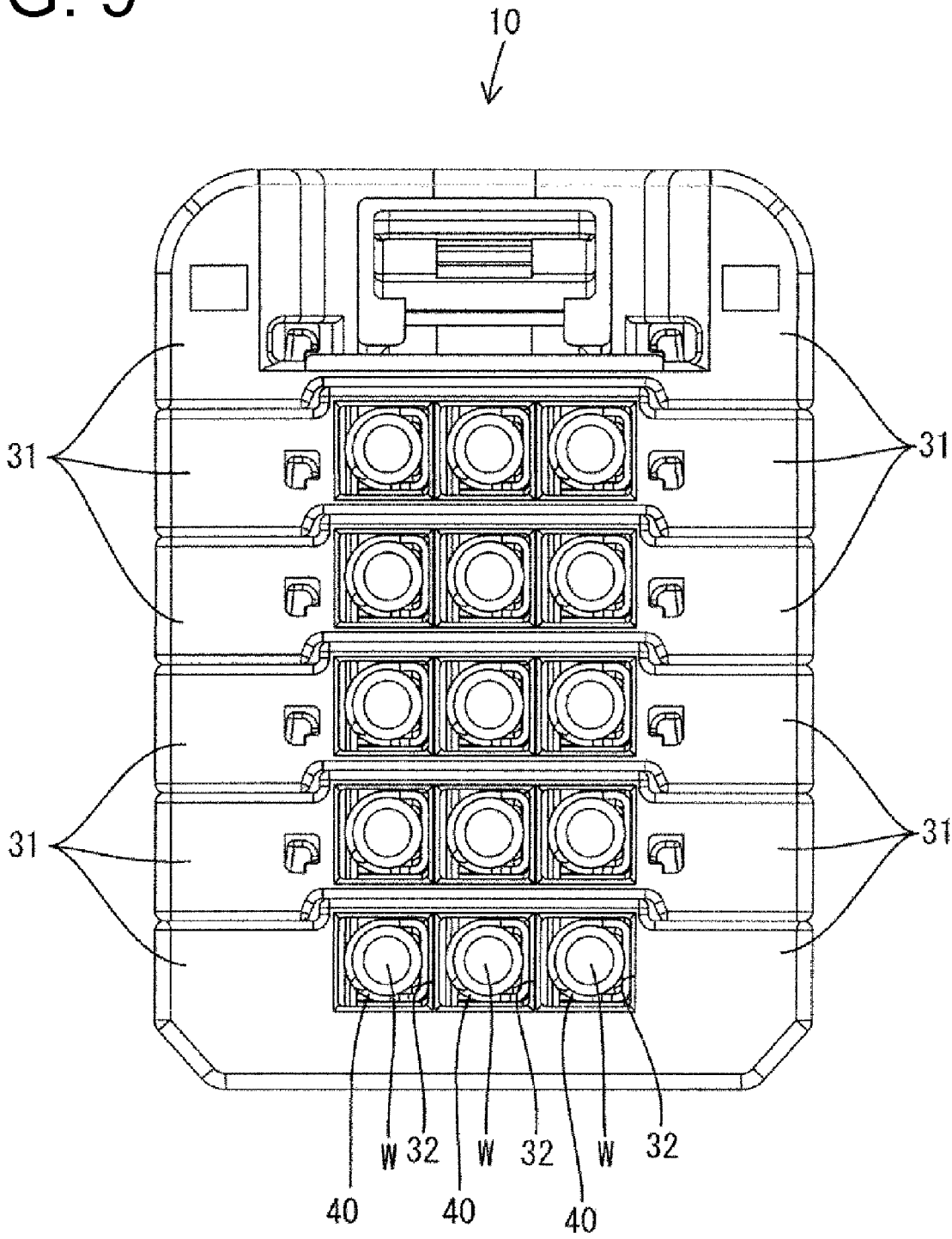
FIG. 9 is a rear view showing the state before the sub-housings are built up.

Four resilient locking pieces 37 are provided on the upper surface of the guide pieces 36 and project up beyond the upper surface of the main body 30. The four resilient locking pieces 37 are arranged to face in the width direction and are spaced apart at specified intervals in forward and backward directions. An inwardly projecting locking claw 37A is provided at the projecting end of each resilient locking piece 37, and an end of the resilient locking piece 37 with the locking claw 37A is displaceable. On the other hand, engageable portions 38 are formed below the guide pieces 36 of the first to fifth sub-housings S1 to S5, as shown in FIG. 8, and are engageable with the locking claws 37A of the resilient locking pieces 37 to lock the vertically adjacent main bodies 30 in a built-up state.

Figure 7:
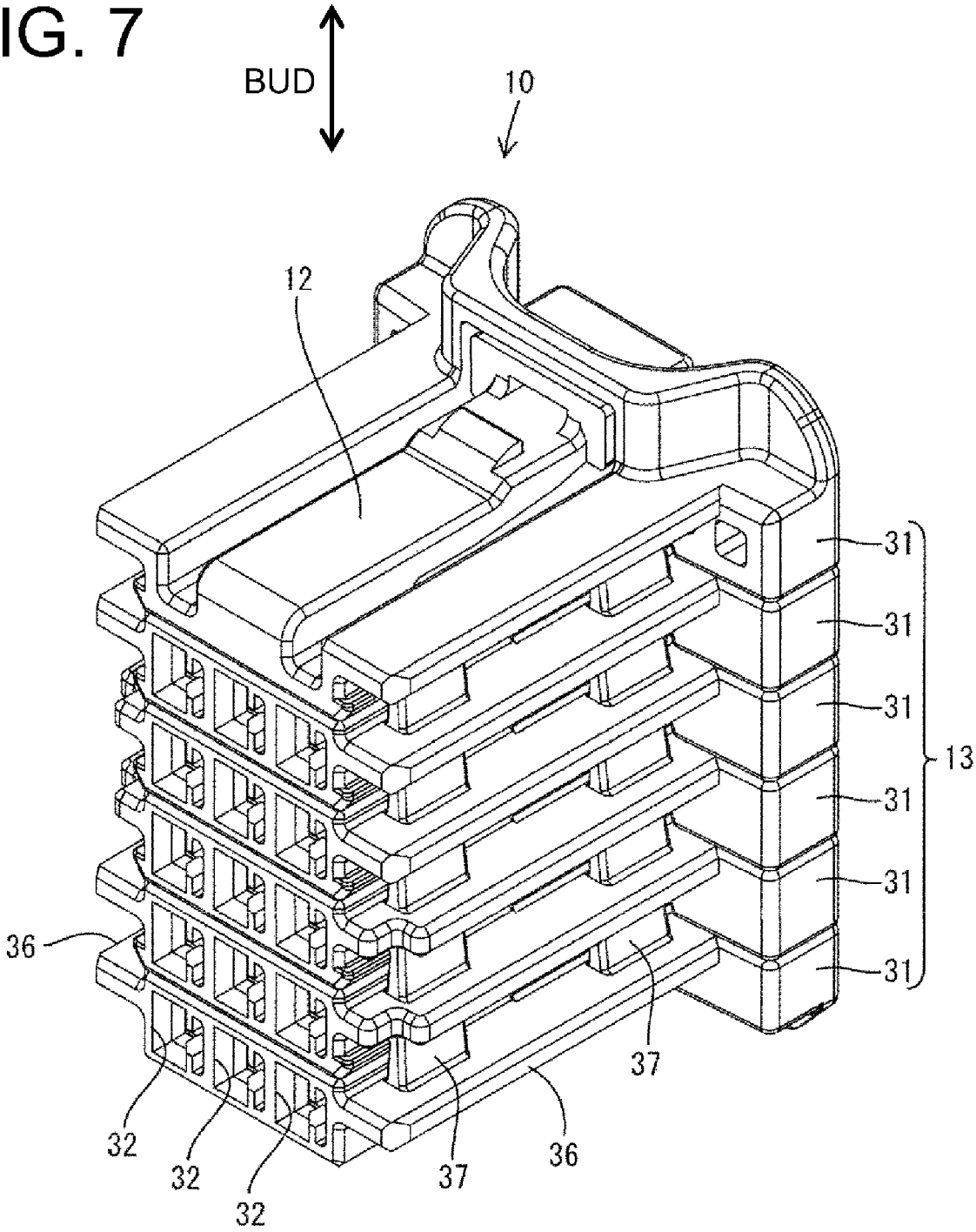
FIG. 7 is a perspective view showing a state after the sub-housings are built up.

As shown in FIG. 7, the hand-push portions 13 are formed by closely building up the projecting pieces 31 of the respective sub-housings S. First through fifth identifying projections A1 through A5 project down from the lower mating surfaces of the projecting pieces 31 of the respective the first through fifth sub-housings S1 through S5. First through fifth identifying recesses B1 through B5 are provided on the upper mating surfaces of the receiving pieces 31 of the sub-housings S2 through S6 for receiving the identifying projections A1 through A5. The identifying projections and identifying recesses are referred to herein by the letters A and B when describing common features. Intervals between the identifying projections A and between the identifying recesses B are substantially equal.

Figure 10:
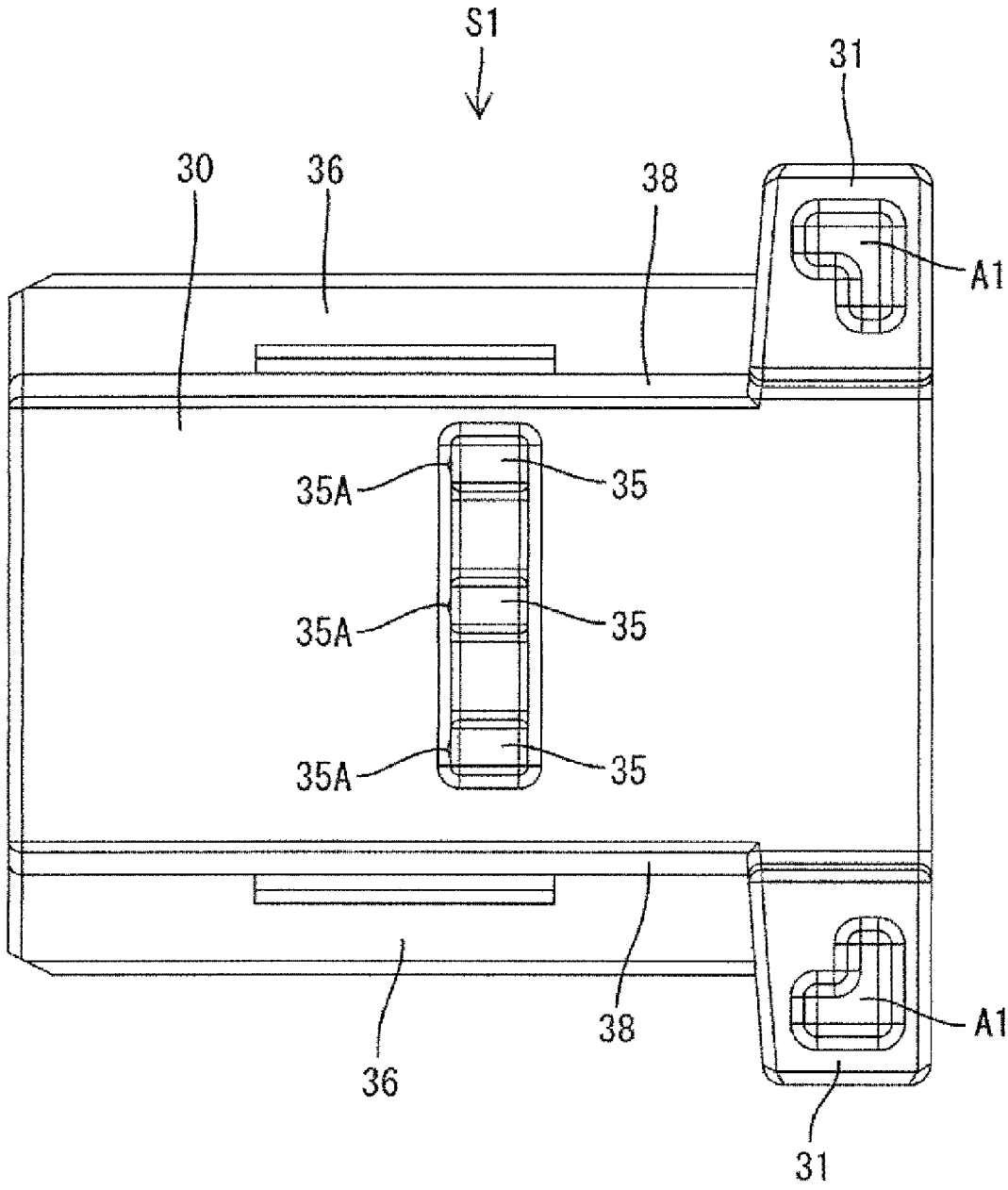
FIG. 10 is a bottom view of a first sub-housing.

As shown in FIG. 10, two first identifying projections A1 project down from the lower surfaces of the respective projecting pieces 31 of the first sub-housing S1. The first identifying projections A1 have substantially L-shaped cross sections aligned so that one side of the L shape extends forward and the other side thereof extends inward in the width direction.

Figure 11:
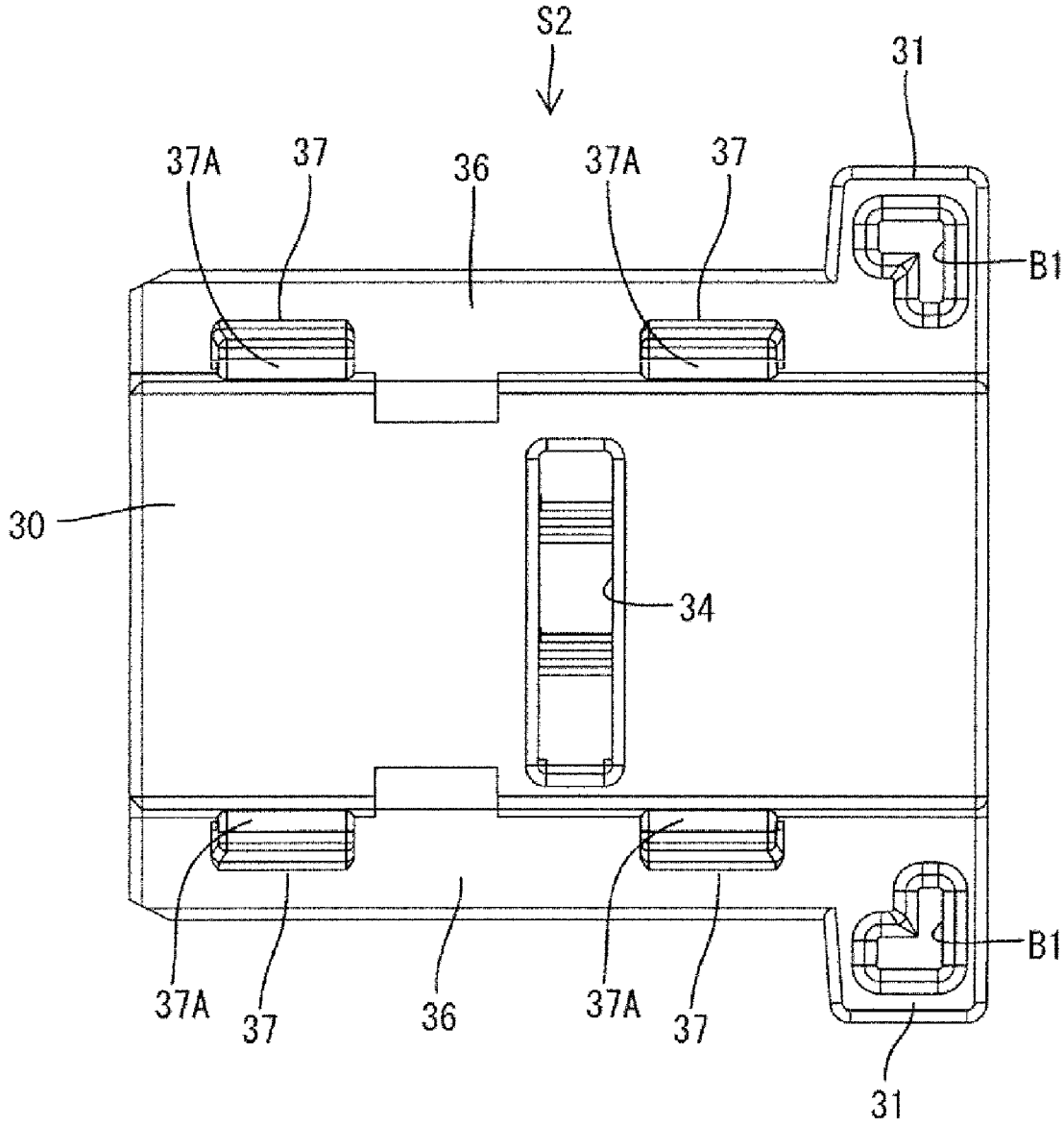
FIG. 11 is a plan view of a second sub-housing.
Figure 12:
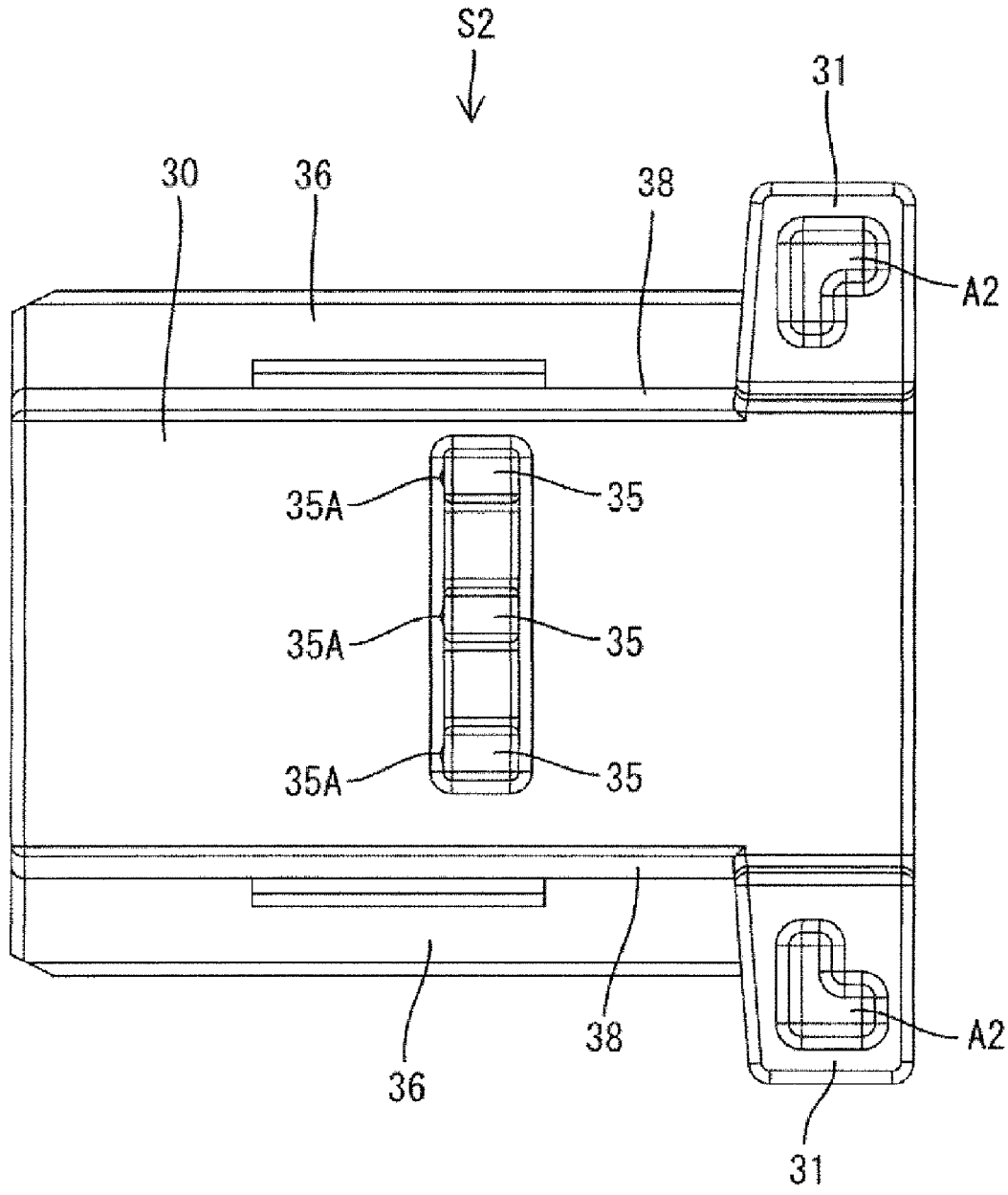
FIG. 12 is a bottom view of the second sub-housing.

As shown in FIG. 11, two first identifying recesses B1 are formed in the upper surfaces of the projecting pieces 31 of the second sub-housing S2. The first identifying recesses B1 have a shape conforming to the cross-sectional shapes of the first identifying projections A1 so that the first identifying recesses B1 can receive the respective first identifying projections A1. Two second identifying projections A2 project down from the lower surfaces of the respective projecting pieces 31 of the second sub-housing S2, as shown in FIG. 12. The second identifying projections A2 have substantially L-shaped cross sections similar to the first identifying projections A1, but are oriented differently so that one side of the L shape extends back and the other side thereof extends inward in the width direction.

Figure 13:
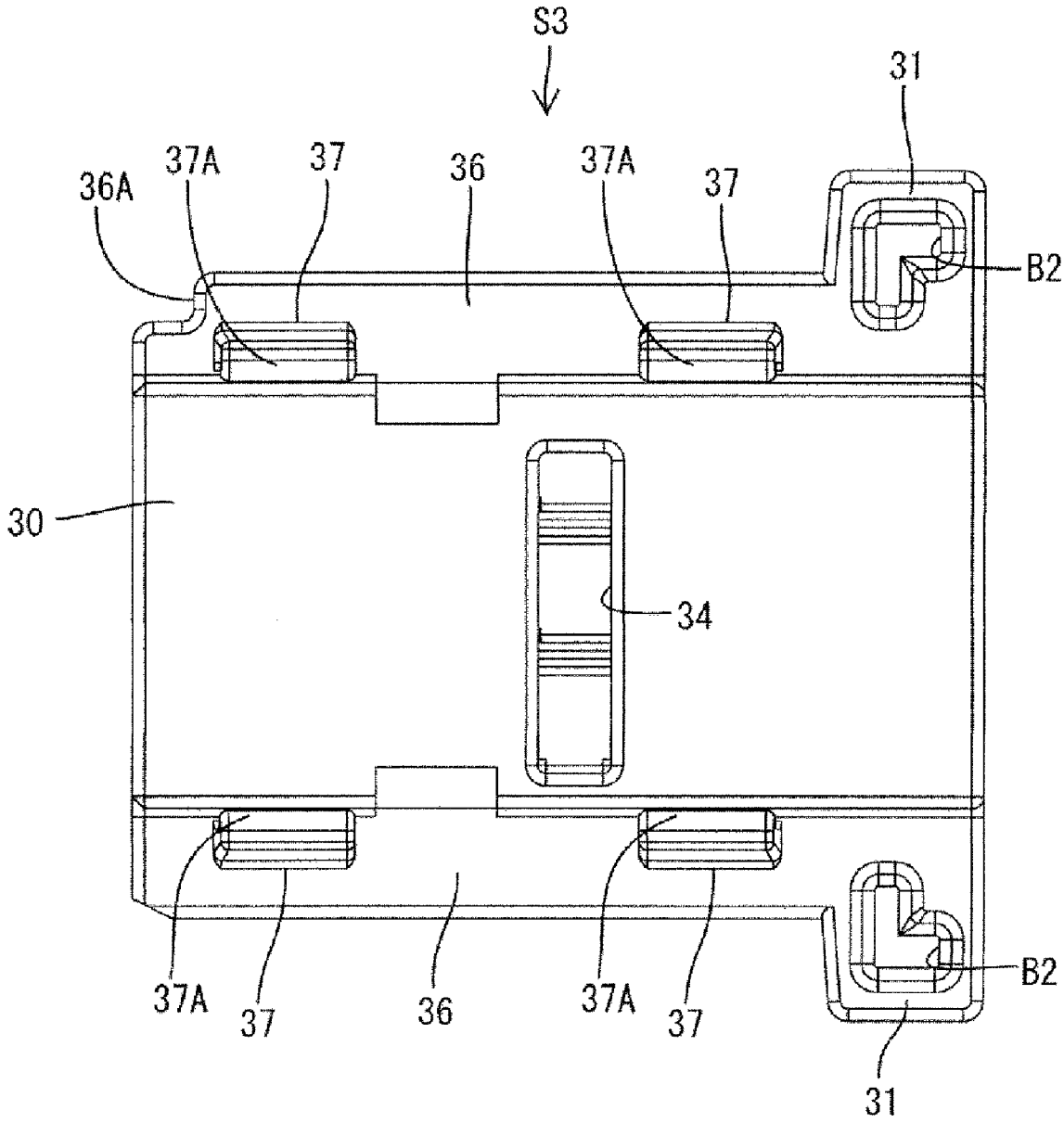
FIG. 13 is a plan view of a third sub-housing.
Figure 14:
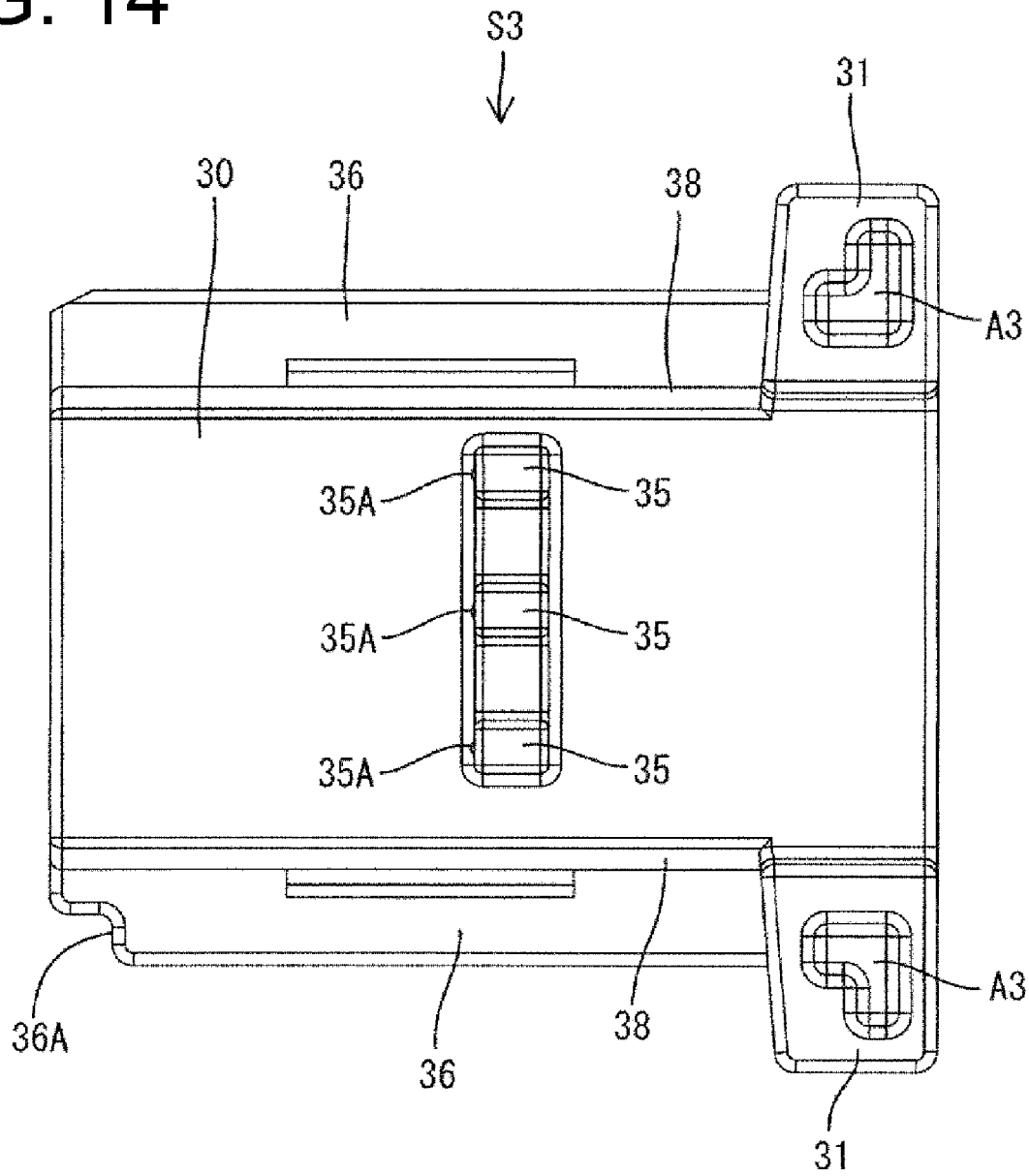
FIG. 14 is a bottom view of the third sub-housing.

As shown in FIG. 13, two second identifying recesses B2 are formed in the upper surfaces of the projecting pieces 31 of the third sub-housing S3. The second identifying recesses B2 have a shape conforming to the cross-sectional shapes of the second identifying projections A2 so that the second identifying recesses B2 can receive the respective second identifying projections A2 therein. On the other hand, two third identifying projections A3 project down from the lower surfaces of the projecting pieces 31 of the third sub-housing S3, as shown in FIG. 14. The third identifying projections A3 have substantially L-shaped cross sections similar to the first identifying projections A1, but are oriented differently so that one side of the L shape extends forward and the other side thereof extends outward in the width direction.

Figure 15:
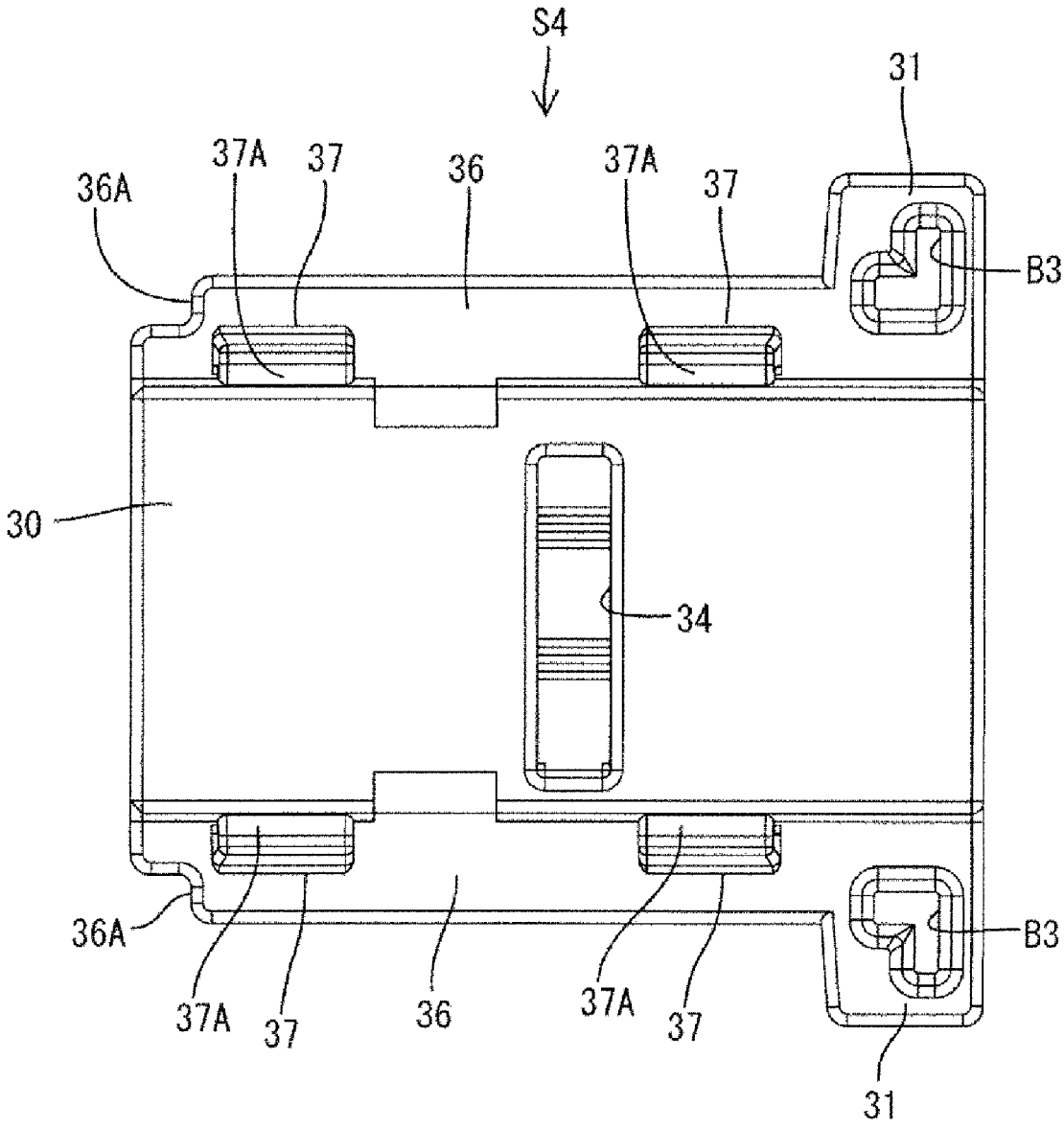
FIG. 15 is a plan view of a fourth sub-housing.
Figure 16:
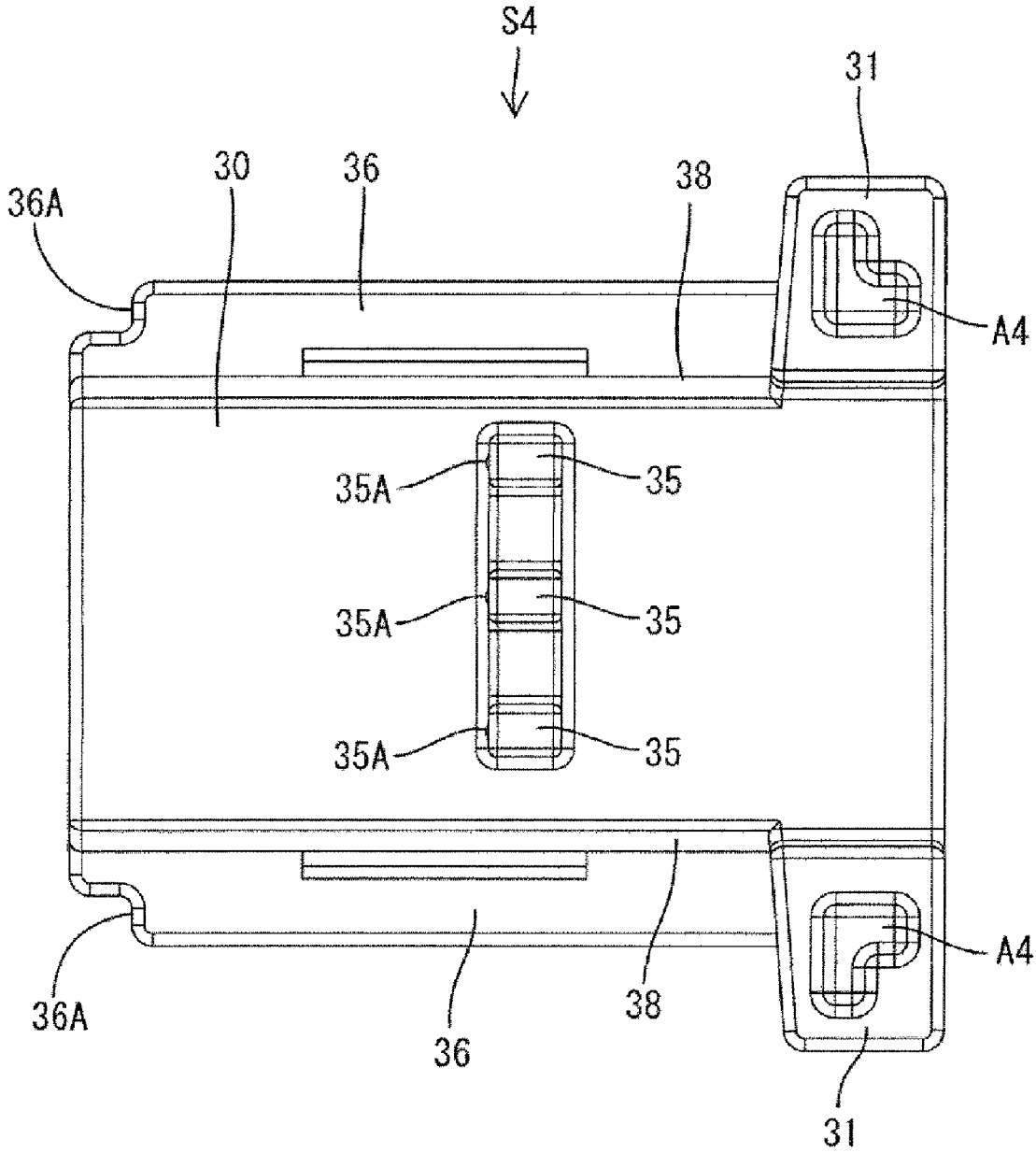
FIG. 16 is a bottom view of the fourth sub-housing.

As shown in FIG. 15, third identifying recesses B3 are formed in the upper surfaces of the projecting pieces 31 of the fourth sub-housing S4. The third identifying recesses B3 have a shape conforming to the cross-sectional shapes of the third identifying projections A3 so that the third identifying recesses B3 can receive the third identifying projections A3. On the other hand, two fourth identifying projections A4 project down from the lower surfaces of the projecting pieces 31 of the fourth sub-housing S4, as shown in FIG. 16. The fourth identifying projections A4 have substantially L-shaped cross sections similar to the first identifying projections A1, but are oriented differently so that one side of the L-shape extends back and the other side thereof extends out in the width direction.

Figure 17:
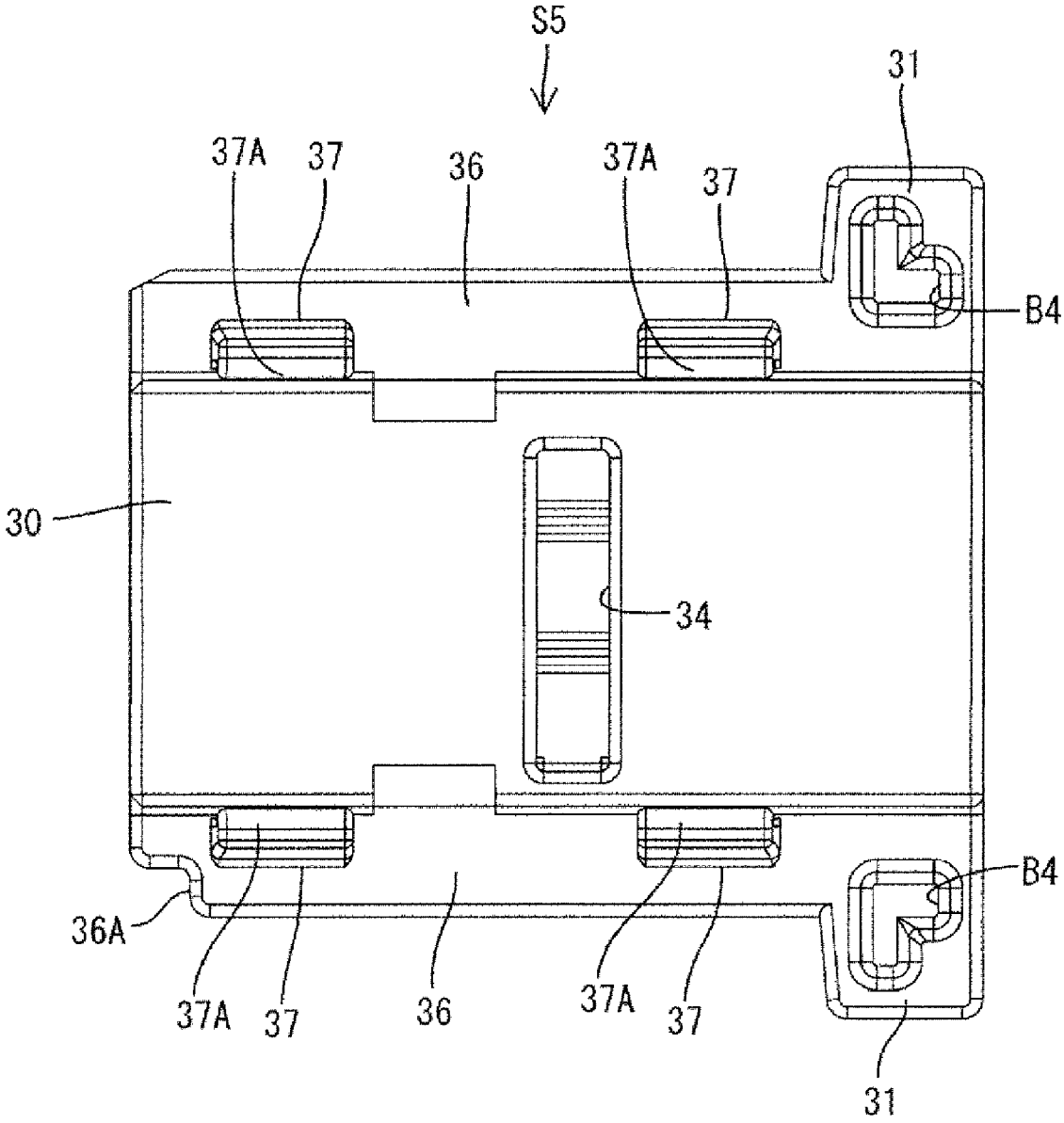
FIG. 17 is a plan view of a fifth sub-housing.
Figure 18:
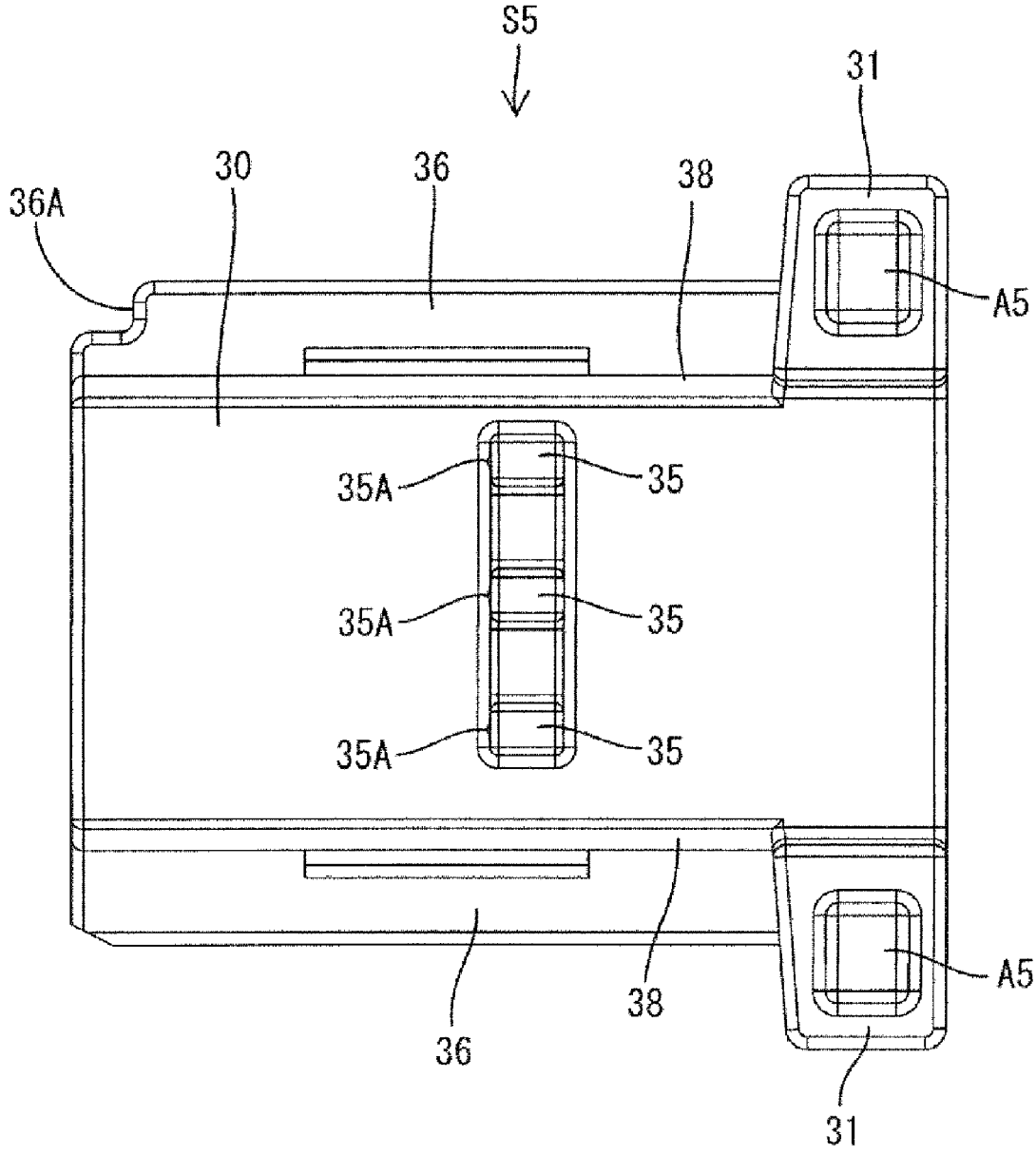
FIG. 18 is a bottom view of the fifth sub-housing.

As shown in FIG. 17, fourth identifying recesses B4 are formed in the upper surfaces of the projecting pieces 31 of the fifth sub-housing S5. The fourth identifying recesses B4 have a shape conforming to the cross-sectional shapes of the fourth identifying projections A4 so that the fourth identifying recesses B4 can receive the fourth identifying projections A4. On the other hand, two fifth identifying projections A5 project down from the lower surfaces of the projecting pieces 31 of the fifth sub-housing S5, as shown in FIG. 18. The fifth identifying projections A4 are substantially rectangular.

Figure 19:
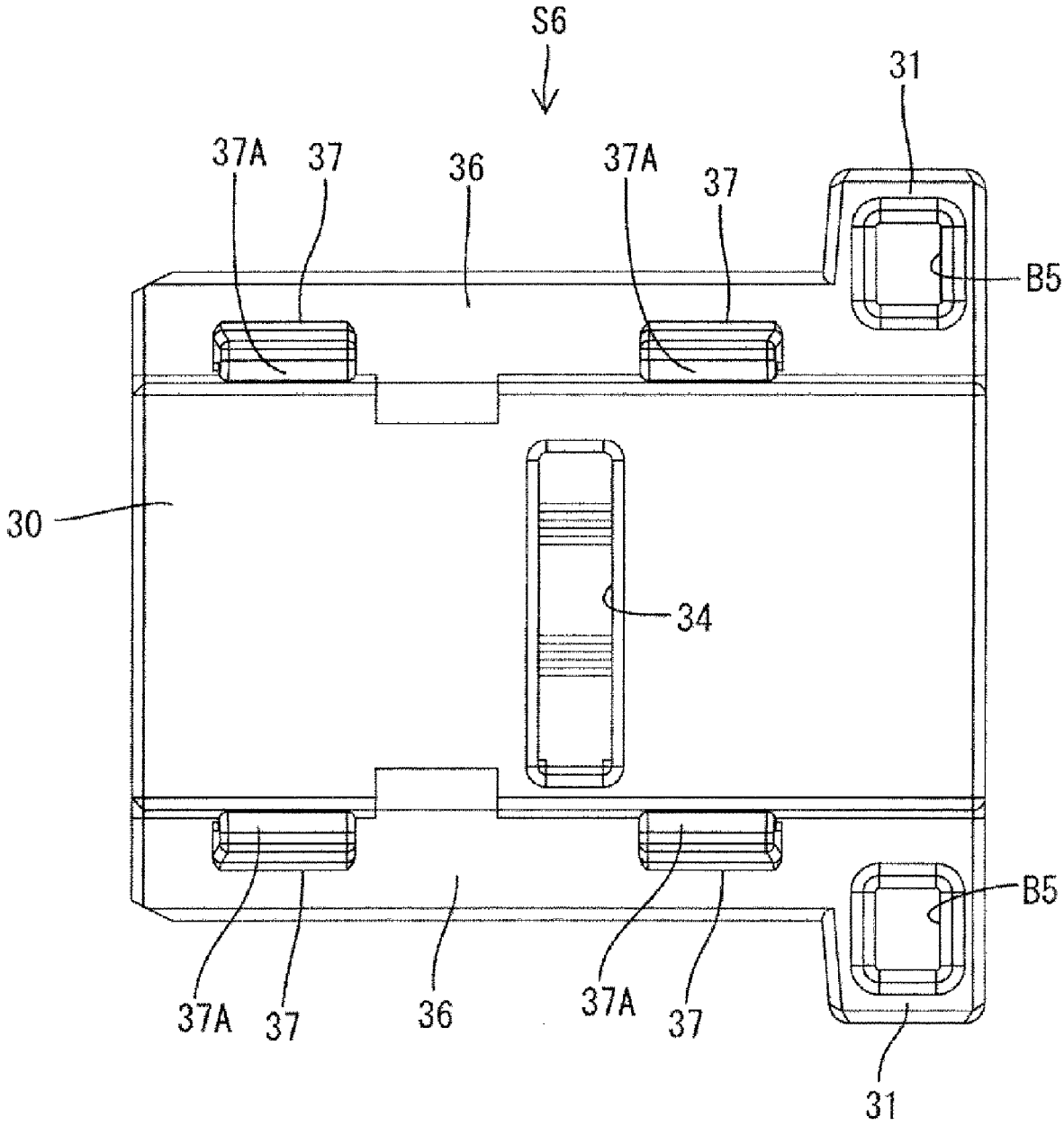
FIG. 19 is a plan view of a sixth sub-housing.

As shown in FIG. 19, fifth identifying recesses B5 are formed in the upper surfaces of the projecting pieces 31 of the sixth sub-housing S6. The fifth identifying recesses B5 have shape conforming to the cross-sectional shapes of the fifth identifying projections A5 so that the fifth identifying recesses B5 can receive the fifth identifying projections A5. The lengths of the sides of the fifth identifying recesses B5 are equal to or substantially larger than the lengths of the respective sides of the L-shapes of the first to fourth identifying recesses A1 to A4. Thus, the fifth identifying recesses B5 can accommodate the fifth identifying projections A5, and also any of the first to fourth identifying projections A1 to A4. In other words, the sixth sub-housing S6 is a common sub-housing that can be used in place of any of the second to fifth sub-housings S2 to S5.

Figure 20:
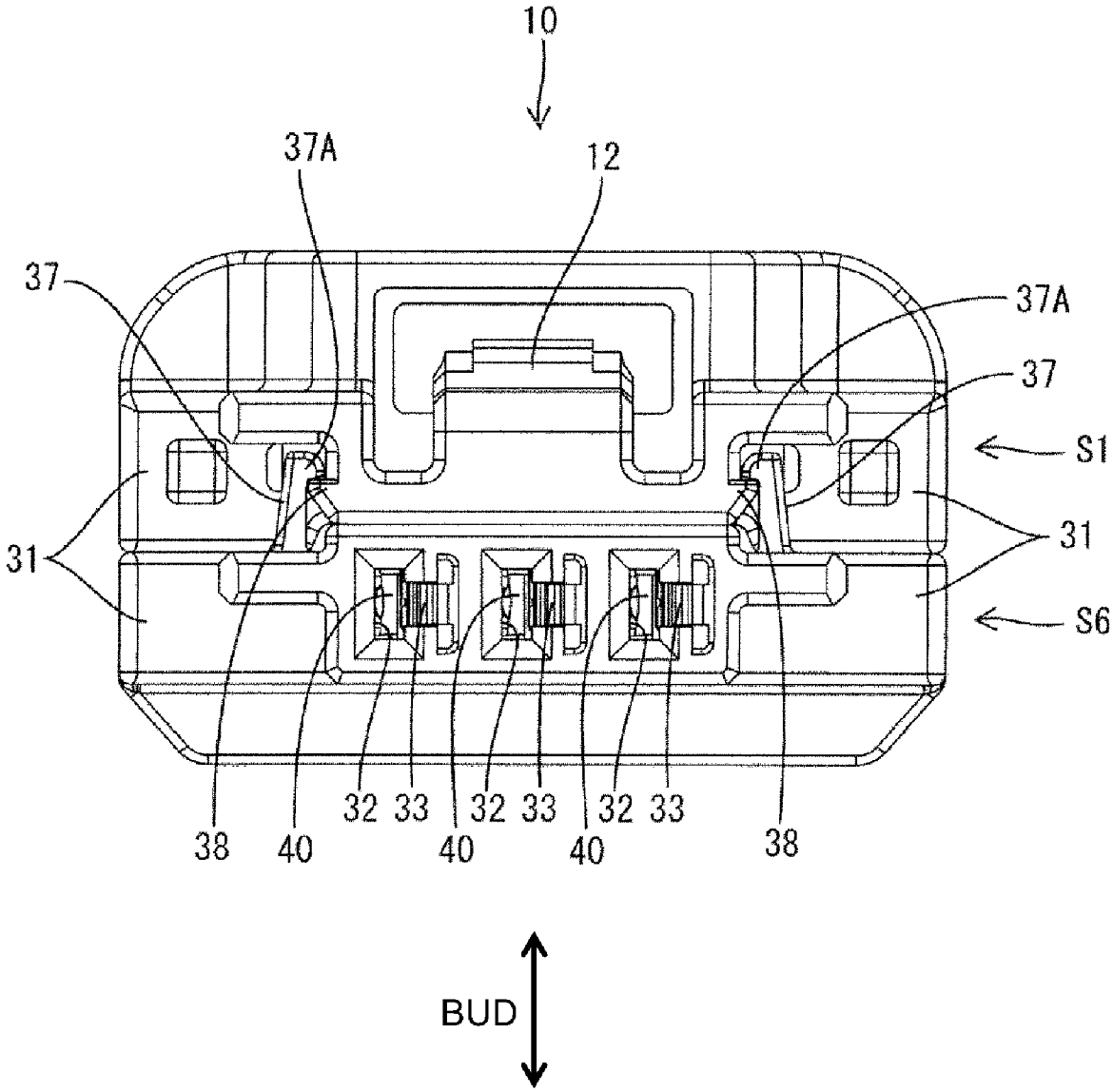
FIG. 20 is a front view showing a joint connector, in which the sub-housings are built up in two levels.
Figure 21:
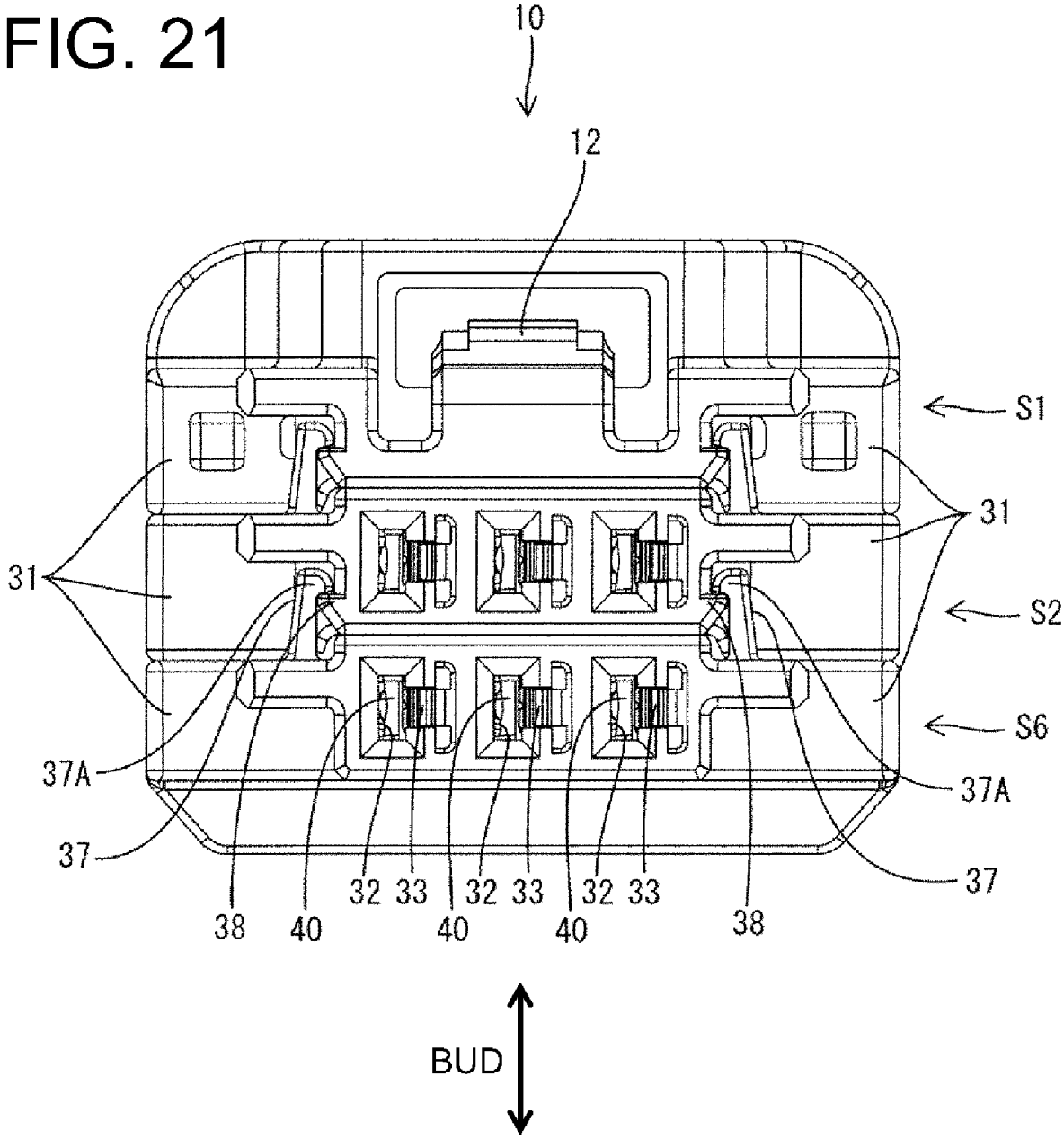
FIG. 21 is a front view showing a joint connector, in which the sub-housings are built up in three levels.
Figure 22:
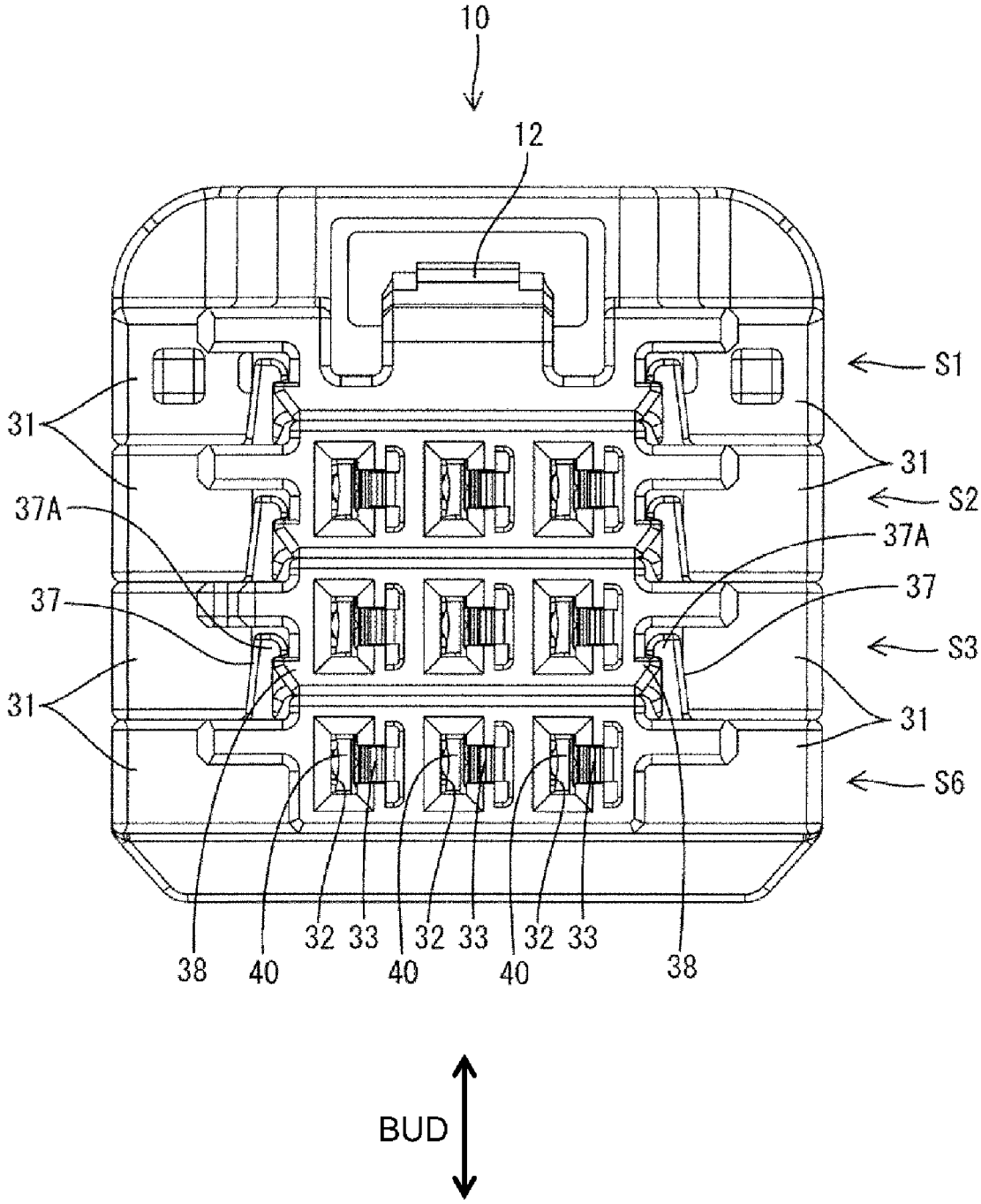
FIG. 22 is a front view showing a joint connector, in which the sub-housings are built up in four levels.
Figure 23:
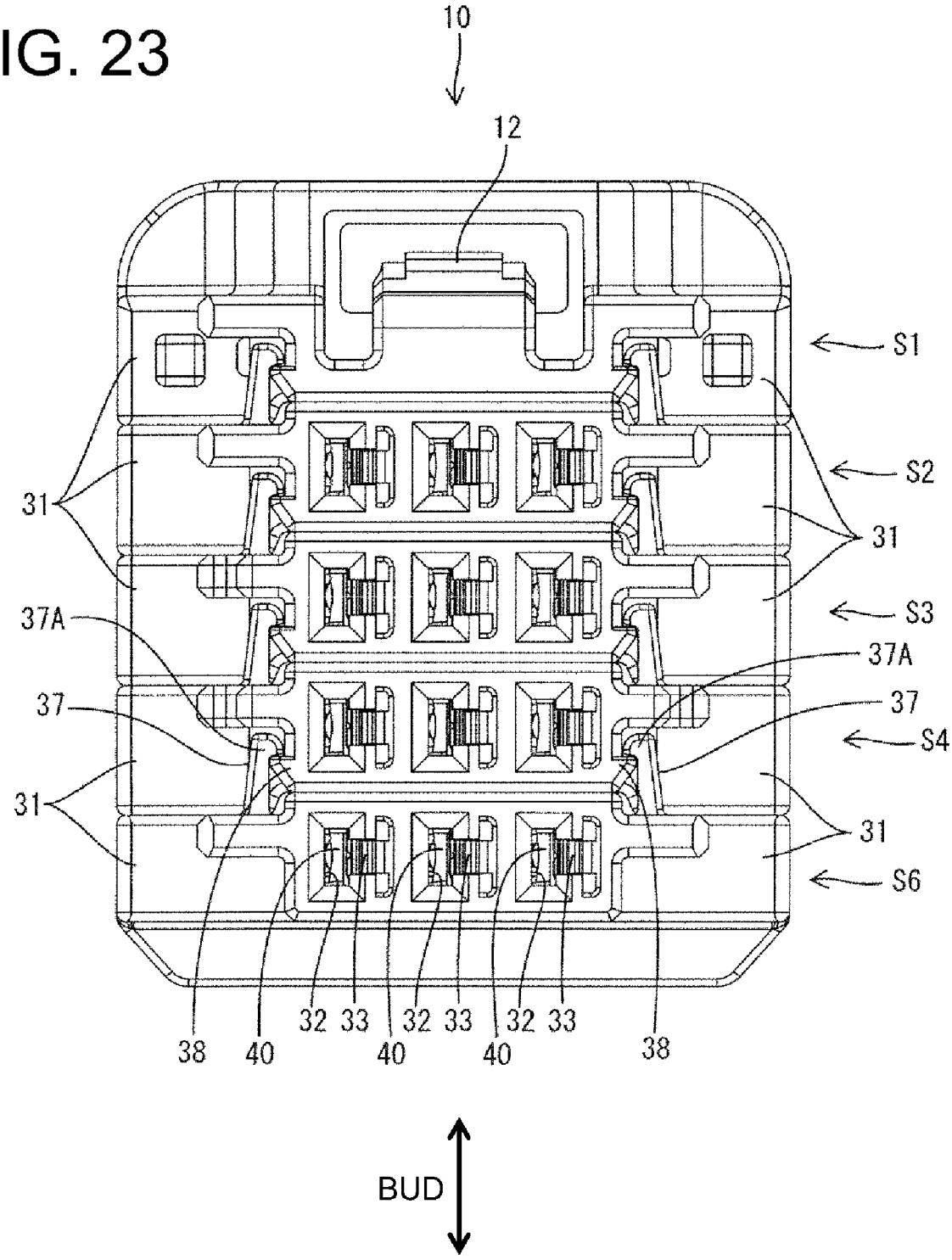
FIG. 23 is a front view showing a joint connector, in which the sub-housings are built up in five levels.

Specific examples of combination are shown in FIGS. 20 to 23. FIG. 20 is a front view showing a state where the first and sixth sub-housings S1, S6 are built up along the built up direction BUD. FIG. 21 is a front view showing a state where the first, second and sixth sub-housings S1, S2 and S6 are built up. FIG. 22 is a front view showing a state where the first, second, third and sixth sub-housings S1, S2, S3 and S6 are built up. FIG. 23 is a front view showing a state where the first, second, third, fourth and sixth sub-housings S1, S2, S3, S4 and S6 are built up.

Accordingly, as shown in FIGS. 10 to 19, the respective identifying projections A have substantially L-shaped cross sections, and the respective identifying recesses B have shapes conforming to the cross-sectional shapes of the corresponding identifying projections A so that the identifying recesses B can receive the corresponding identifying projections A only when the sub-housings S are built up properly in the built up direction BUD.

The terminal fittings 40 connected with the wiring harness W are inserted into the specified cavities 32 and the sub-housings S are built up along the built up direction BUD after all of the terminal fittings 40 are inserted. The respective first identifying projections A1 enter the corresponding first identifying recesses B1 so that the first and second sub-housings S1, S2 can be built up. The locking claws 37A then move over the engaging portions 38 and the resilient locking pieces 37 deform out in the width direction. The resilient locking pieces 37 so that the locking claws 37A engage the engaging portions 38 to hold the first and second sub-housings S1, S2 together.

Figure 24:
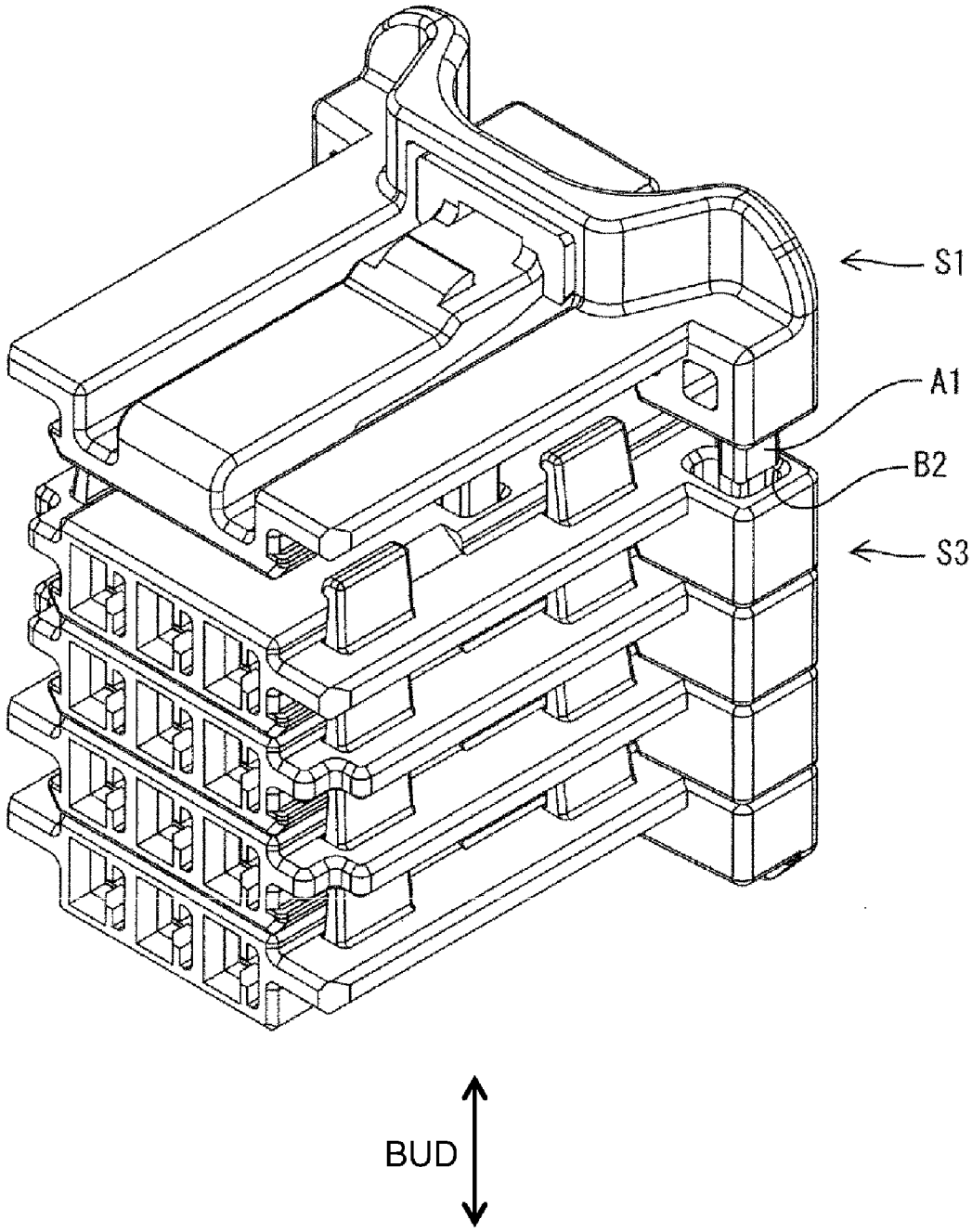
FIG. 24 is a perspective view showing a state of preventing an erroneous buildup of the respective sub-housings.
Figure 25:
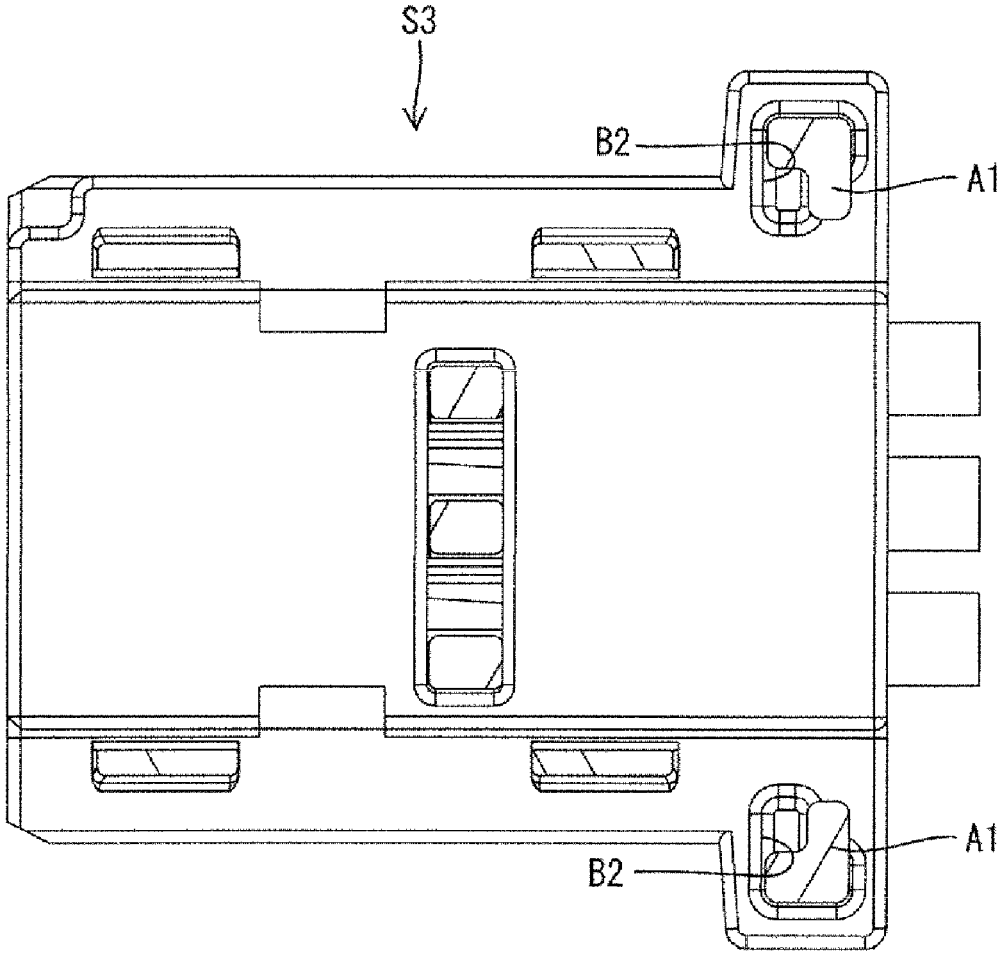
FIG. 25 is a plan view showing the state of preventing the erroneous buildup of the respective sub-housings.

An attempt could be made to build up the first and third sub-housings S1, S3 as shown in FIG. 24. However, the bottom ends of the first identifying projections A1 interfere with the opening edges of the respective second identifying recesses B2, as shown in FIG. 25 to prevent the building-up of the sub-housings S1, S3. Thus, an operator performing this building-up operation notices an erroneously built-up state, and can stop the building-up operation of the sub-housings S1, S3 and resume the building-up operation with a correct combination.

The joint connector 10 is constructed by arranging sub-housings S having the proper combination of identifying projections Ai and identifying recesses Bi on each other. The properly built up joint connector 10 then is inserted into the fitting recess 22 of the intermediate connector 20. More particularly, the guide pieces 36 are inserted into the corresponding guide grooves 27 to guide the connecting operation of the connectors 10, 20. The lock 12D deforms the lock arm 12 down towards the sub-housing S1 during the connection process. However, the lock arm 12 is restored resiliently at complete connection so that the lock 12D engages the inner peripheral surface of the lock hole 25. In this way, the joint connector 10 and the intermediate connector 20 are held together. Simultaneously, the terminal fittings 40 of the joint connector 10 and the intermediate terminals 24 of the intermediate connector 20 are connected electrically. The other joint connector 10 is built up in the manner described above so that the wiring harnesses W connected with the terminal fittings 40 of both joint connectors 10 are connected electrically with each other.

The orientations of the cross-sectional shapes of the identifying projections A and the identifying recesses B coincide if the sub-housings S are built up properly. Thus, the identifying projections A are received in the identifying recesses B to prevent an erroneous buildup of the sub-housings S.

The identifying projections A and the identifying recesses B are formed on the existing hand-push portions 13. Thus, the joint connector 10 can be made smaller as compared with the case where the identifying projections A and the identifying recesses B are provided separately.

The projecting pieces 31 are parts of the hand-push portions 13 and are provided near the rear of the sub-housings S. Thus, it is not necessary to thin the inner walls of the cavities 32.

The identifying projections A and the identifying recesses B are aligned in the build-up direction with the intervals between the identifying projections A and the intervals between the identifying recesses B fixed. Thus, the joint connector 10 is not made wider.

The sixth sub-housing S6 in the bottommost level is the common sub-housing. Thus, it is not necessary to provide a separate sub-housing in the bottommost level even if the number of the levels of the joint connector 10 is changed as shown in FIGS. 20 to 23.

The hand-push portions 13 are provided near the rear part of the joint connector 10. Thus, the joint connector 10 can be pushed steadily until the two connectors 10, 20 are connected properly when connecting the joint connector 10 with the intermediate connector 20.

Figure 26:
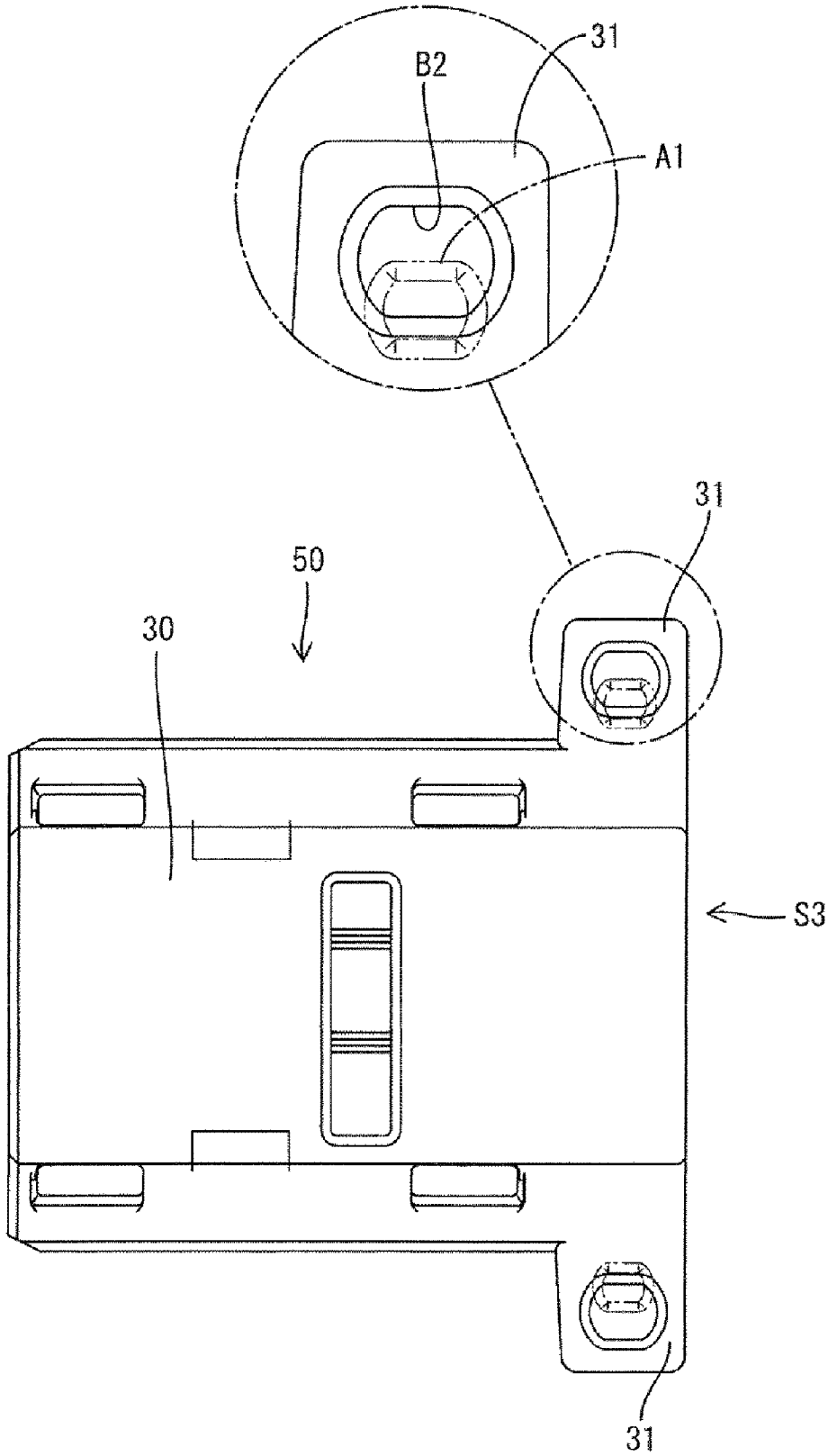
FIG. 26 is a plan view showing a state of preventing an erroneous buildup of sub-housings in a modified embodiment.

A modified embodiment of the invention is described with reference to FIG. 26. A joint connector 50 of this embodiment is differentiated from the joint connector 10 of the first embodiment mainly by modifying the constructions of the identifying projections A and the identifying recesses B. Other similar constructions, functions and effects are not described.

Identifying projections A of the joint connector 50 are provided on the lower surfaces of the respective projecting pieces 31 and define columns having substantially rectangular cross sections that are longer in forward and backward directions. On the other hand, identifying recesses B are provided in the upper surfaces of the projecting pieces 31 and have shapes that conform with the cross-sectional shapes of the identifying projections A. The identifying projections A enter the respective identifying recesses B if the sub-housings S are built up properly because intervals between the identifying projections A and between the identifying recesses B coincide. However, the interval between the identifying projections A does not coincide with the interval between the identifying recesses B, as shown in FIG. 26, if the sub-housings are not built up properly. Therefore the sub-housings S cannot be built up. In other words, the bottom ends of the respective identifying projections A interfere with the upper surfaces of the respective projecting pieces 31 to prevent a building-up operation.

As described above, an erroneous buildup of the sub-housings S of this embodiment is prevented merely by setting the interval between the identifying projections A so as not to coincide with the interval between the identifying recesses B unless the sub-housings S are built up properly. In other words, unlike the first embodiment, it is not necessary to form the identifying projections A with complicated cross-sectional shapes and to set them in different orientations on the respective mating surfaces. Therefore, the identifying projections A can have simple cross-sectional shapes such as substantially rectangular shapes or round shapes.

The invention is not limited to the above described and illustrated embodiments. For example, the following embodiments are also embraced by the technical scope of the present invention as defined by the claims.

Joint connectors 10 with sub-housings built up in two and six levels, are illustrated in the above embodiments. However, the invention also is applicable to joint connectors, in which the respective sub-housings S are built up in three, four, five, seven or more levels.

The hand-push portions 13 project toward the opposite widthwise sides at the rear part of the joint connector 10 in the first embodiment. However, only one hand-push portion may project only to one of the opposite widthwise sides according to the present invention.

The hand-push portions 13 project in width direction in the above embodiments. However, they may project back or at any other angle.

The identifying projections A are formed on the lower surfaces of the projecting pieces 31 in the above embodiments. However, the identifying projections A may be on the upper surfaces and the identifying recesses B may be on the upper surfaces. In other words, the identifying projections A are on one mating surface of one sub-housing and the corresponding identifying recesses B are on a mating surface of the adjacent sub-housing S.

The identifying projections A have substantially L-shaped cross sections in the first embodiment. However, the cross-sectional shapes of the identifying projections A are not limited to the substantially L shapes provided that they can identify correct combinations. For example, the identifying projections A may have substantially T, Z- or X-shaped cross sections.

Although the respective identifying projections A are formed laterally symmetrical on each mating surface in the above embodiments, they may be oriented in the same direction according to the present invention.

The sixth sub-housing in the bottommost level is the common sub-housing if the number of the levels of the joint connector 10 is changed in the above embodiments. However, it is not always necessary to use the sub-housing in the bottommost level as the common sub-housing.

A construction for preventing displacements of the sub-housings S of the preferred embodiment is described with reference to FIGS. 27 to 31. Specified clearances are set over substantially the entire periphery between the opening edges of the retainer insertion openings 34 and the outer peripheral walls of the retainers 35 to reduce connection forces exerted upon building up the sub-housings S. However, these clearances would permit the sub-housings S to be displaced along directions lying in the plane of mating surfaces of the sub-housings S. Thus, as shown in FIGS. 27 to 31, ribs 35A are provided near the base ends on the front surfaces of the retainers 35 for substantially filling clearances in forward and backward directions to prevent the sub-housings S from being displaced in forward and backward directions.

Figure 27:
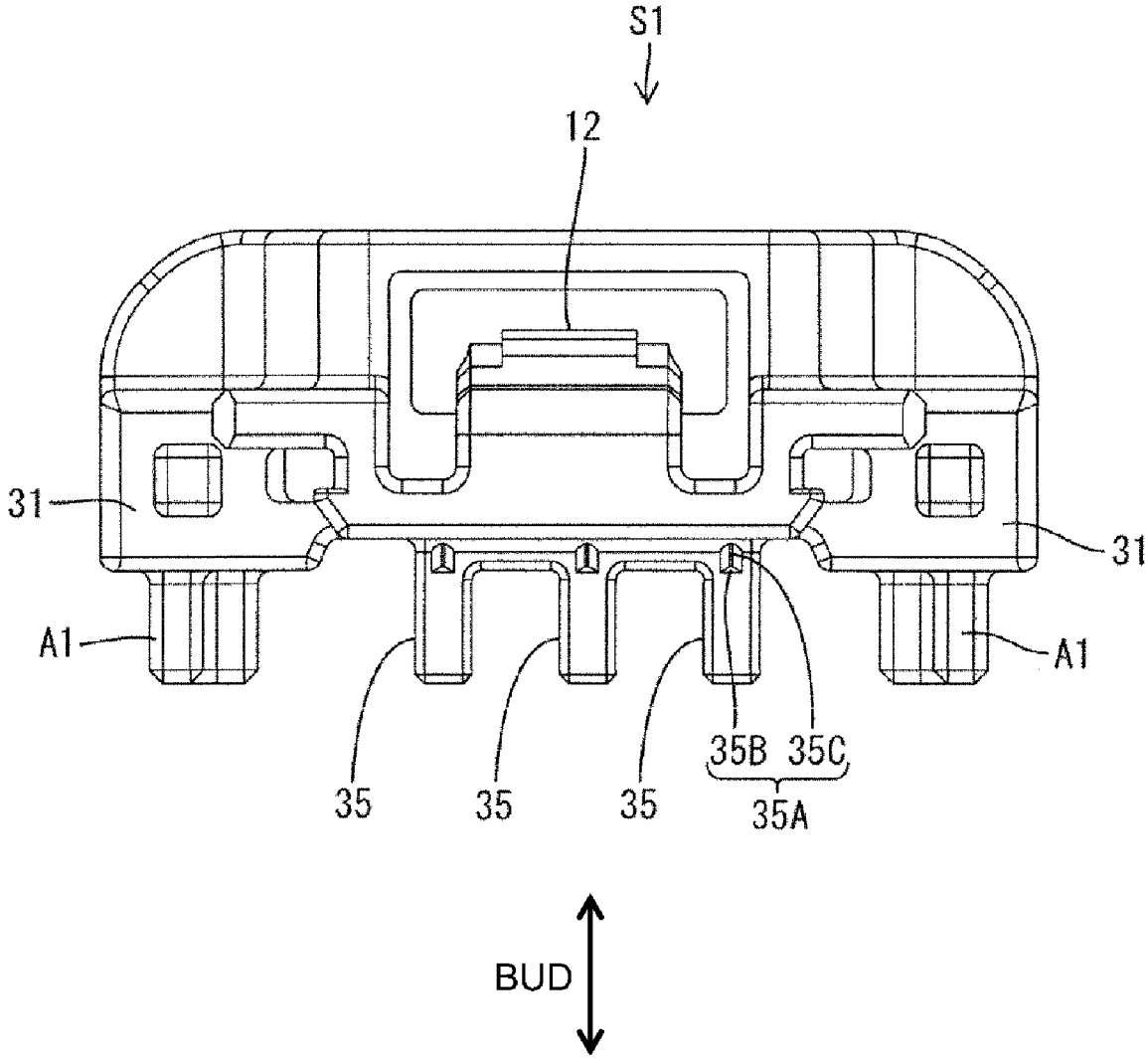
FIG. 27 is a front view of the first sub-housing.
Figure 28:
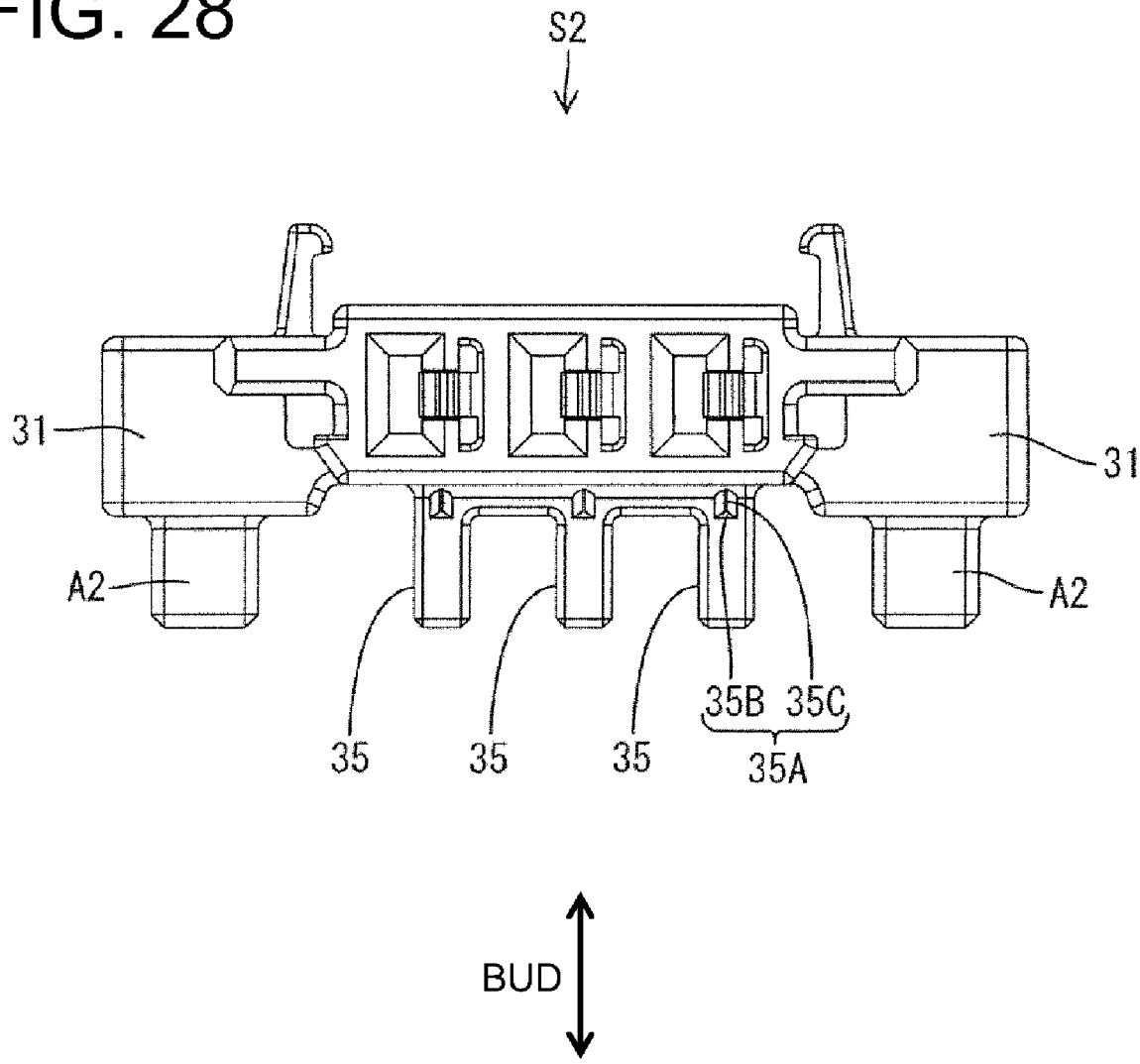
FIG. 28 is a front view of the second sub-housing.
Figure 29:
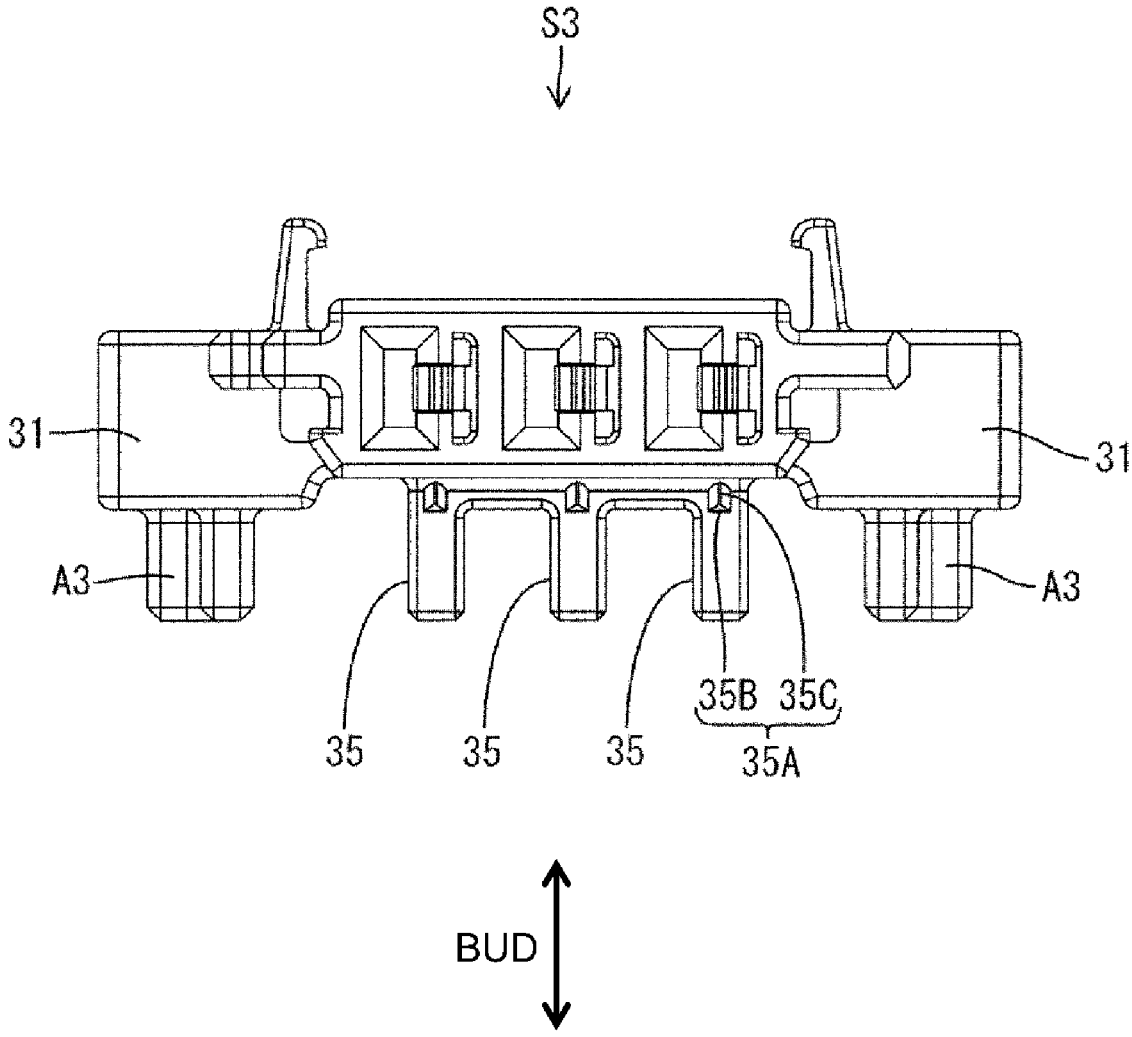
FIG. 29 is a front view of the third sub-housing.
Figure 30:
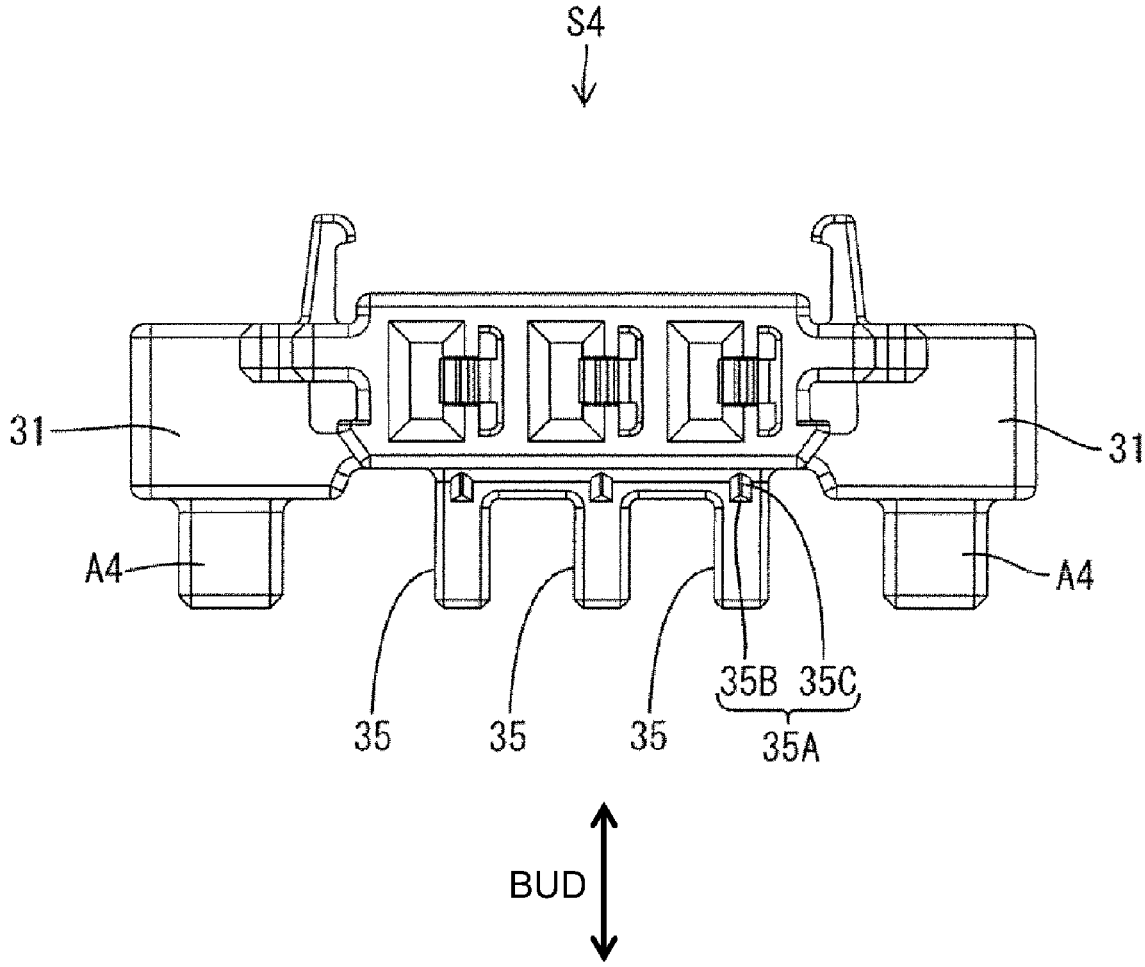
FIG. 30 is a front view of the fourth sub-housing.
Figure 31:
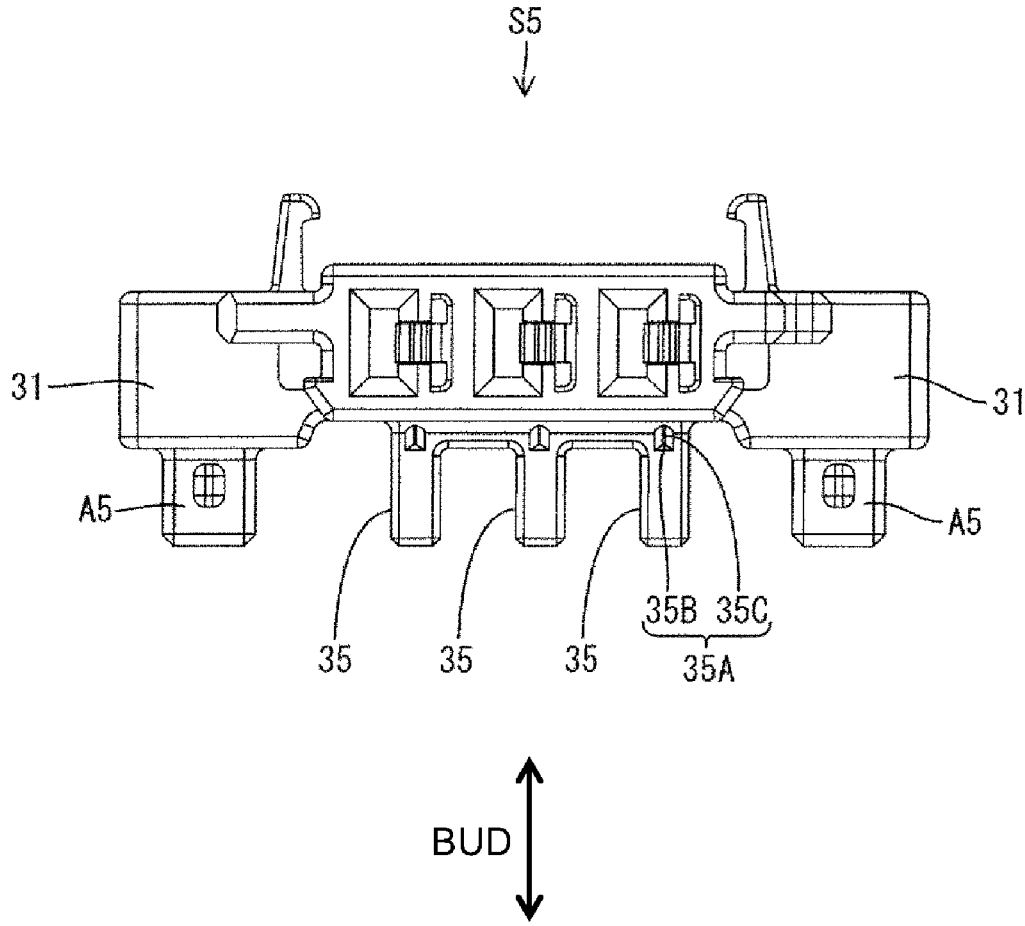
FIG. 31 is a front view of the fifth sub-housing.
Figure 32:
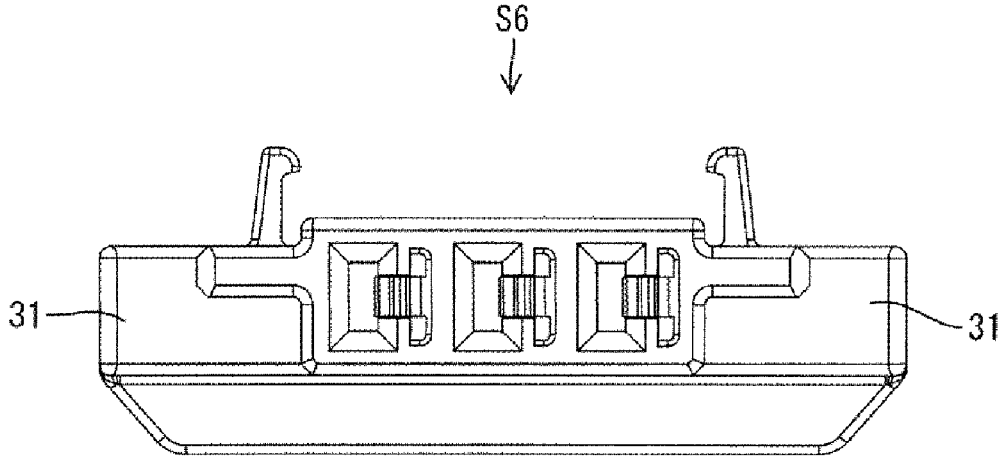
FIG. 32 is a front view of the sixth sub-housing.
Figure 33:
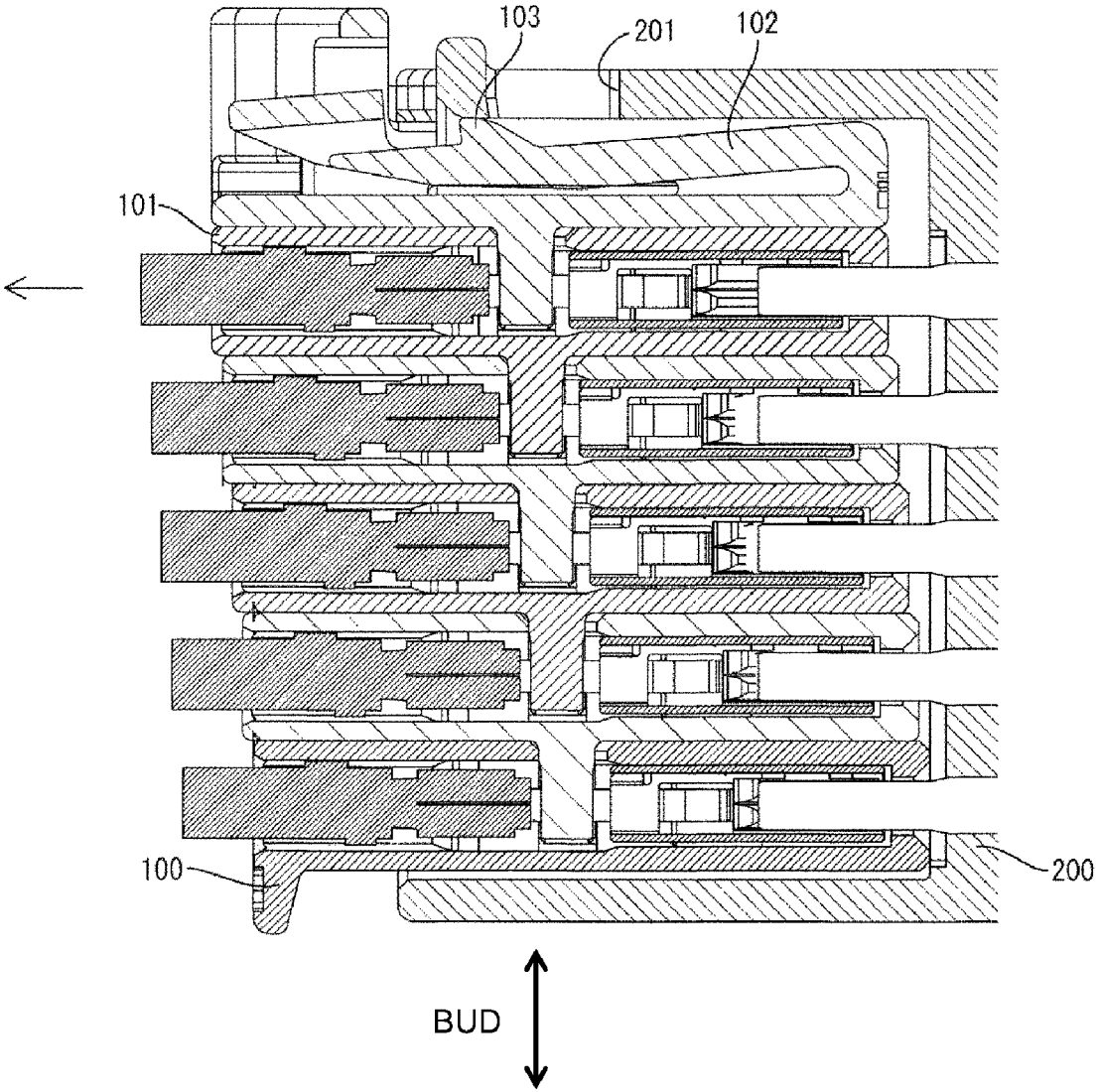
FIG. 33 is a diagram showing a state where the respective sub-housings are displaced.

The ribs 35A are substantially identical in the sub-housings S, and hence they are described only for the first sub-housing S1. As shown in FIG. 27, each rib 35A is a column that extends vertically along the build-up direction BUD with a converging substantially triangular cross section. A bottom end corner of each rib 35A is cut obliquely forward. More specifically, a slanted guide surface 35B is formed at the bottom end of the rib 35A and extends obliquely forward and upward. A holding portion 35C extends up from the upper end of the slanted guide surface 35B. The slanted guide surfaces 35B can guide each sub-housing S to a proper position by sliding in contact with the front side of the opening edge of the retainer insertion opening 34 when building up the sub-housings S. Further, the holding portions 35C hold each sub-housing S at the proper position by contacting the front side of the opening edge of the retainer insertion opening 34 following the guiding operation by the slanted guide surfaces 35B.

Although the first to fifth sub-housings S1 to S5 are provided with the ribs 35A and the second to sixth sub-housings S2 to S6 are formed with the retainer insertion openings 34 in this embodiment, the second to sixth sub-housings S2 to S6 may be formed with the ribs 35A and the first to fifth sub-housings S1 to S5 may be formed with the retainer insertion openings 34. Although the ribs 35A preferably are provided on the retainers 35 in this embodiment, they may be provided on the opening edges of the retainer insertion openings 34 or may be provided on both the ribs 35A and the opening edges of the retainer insertion openings 34. Further, although the displacements of the sub-housings S in forward and backward directions are restricted in this embodiment, those in width direction also can be restricted.

The terminal fittings 40 connected with the wiring harness W are inserted into the specified cavities 32 and then the sub-housings S are built up along the built-up direction BUD. For example, in the case of building up the first and second sub-housings S1, S2, the first identifying projections A1 are accommodated into the corresponding first identifying recesses B1 so that the sub-housings S1, S2 can be built up.

At this time, the retainers 35 of the first sub-housing S1 enter the cavities 32 through the retainer insertion opening 34 of the second sub-housing S2. The specified clearance is set between the opening edge of the retainer insertion opening 34 and the outer peripheral walls of the retainers 35 facing this opening edge. Thus, a connecting force during the building-up operation is reduced. The slanted guide surfaces 35B of the ribs 35A slide in contact with the opening edge of the retainer insertion opening 34 so that each sub-housing S is guided to the proper position. Subsequently, the holding portions 35C of the ribs 35A contact the opening edge of the retainer insertion opening 34 so that each sub-housing S is held at the proper position.

Substantially in parallel with these operations, the locking claws 37A move over the engaging portions 38 and cause the resilient locking pieces 37 to deform out in the width direction. The resilient locking pieces 37 then restore resiliently to engage the locking claws 37A and to hold the sub-housings S in a built-up state. The joint connector 10 is inserted into the fitting recess 22 of the intermediate connector 20 after the sub-housings have been built up properly.

At this time, the guide pieces 36 enter the corresponding guide grooves 27 to guide the connecting operation of the two connectors 10, 20. Further, the lock arm 12 is deformed resiliently in and down and then is restored resiliently to engage the lock 12D with the inner peripheral surface of the lock hole 25. In this way, the joint connector 10 and the intermediate connector 20 are held inseparably, and the terminal fittings 40 of the joint connector 10 and the intermediate terminals 24 of the intermediate connector 20 are connected electrically. The other joint connector 10 is built up in the same manner as above and is connected with the intermediate connector 20. Thus, the wiring harnesses W connected with the terminal fittings 40 of the joint connectors 10 are connected with the intermediate connector 20 and are connected electrically with each other.

The connecting operation could be performed by pushing only the sixth sub-housing S6 towards the intermediate connector 20. Therefore the connecting operation could be completed before the lock arm 12 of the first sub-housing S1 reaches the proper connection position and the lock projection 12D could be left without fitting in the lock hole 25. However, displacements of the sub-housings S are restricted by the ribs 35A on the retainers 35.

The specified clearances are set between the opening edges of the retainer insertion openings 34 and the outer peripheral walls of the retainers 35 before the ribs 35A contact the opening edges of the retainer insertion openings 34. Thus, connection forces exerted upon building up the respective sub-housings S can be reduced.

The slanted guide surfaces 35B of the ribs 35A slide in contact with the opening edges of the retainer insertion openings 34 at the time of building up the respective sub-housings S. Thus, the sub-housings S can be guided to the proper positions. The holding portions 35C of the ribs 35A then contact the opening edges of the retainer insertion openings 34 to hold the sub-housings S at the proper positions.

The invention is not limited to the above described and illustrated embodiment. For example, the following embodiments are also embraced by the technical scope of the present invention as defined by the claims.

Although the ribs 35A are integral to the sub-housings S in the above embodiment, they may be separate from the sub-housings S.

The ribs 35A project at the base ends of the retainers 35 in the above embodiment. However, they may be longer in the lengthwise directions of the retainers 35 according to the invention. In other words, the specified clearances may not necessarily be provided over the entire periphery between the opening edges of the retainer insertion openings 34 and the outer peripheral walls of the retainers 35.

The ribs 35A include the slanted guide surfaces 35B in the above embodiment. However, slanted guide surfaces may be provided on the opening edges of the retainer insertion openings 34 or may be provided on both the ribs 35A and the opening edges of the retainer insertion openings 34.

An electrical connection test is conducted before the sub-housings S are built up to inspect whether the terminal fittings 40 are connected with a correct wiring harness W. This electrical connection test brings conducting probes E of an inspection apparatus (not shown) into contact with the front ends of the respective terminal fittings 40, as shown in FIGS. 34 to 37 to verify whether the terminal fittings 40 are connected with the correct wiring harness W. However, the electrical connection test cannot verify whether the terminal fittings 40 are accommodated in the correct sub-housing S. Accordingly, contact probes C are provided in addition to the conducting probe E to detect the erroneous mounting of the sub-housing S.

The inspection apparatus includes an inspection unit that includes the conducting probe E, the contact probes C, a mounting portion in which the sub-housing S is mounted before being built up, and an operation lever for bringing the inspection unit towards and away from the sub-housing S mounted in the mounting portion. Each contact probe C includes a contact sensor, and a detection signal is sent to a controller (not shown) when an object contacts the sensor. The controller determines the presence or absence of the cutout 36A based on the detection signal from the contact probe C.

Detectable portions are located at front ends of the guide pieces 36 of the second to fifth sub-housings S2 to S5. The contact probes C detect the detectable portions to identify the type of the sub-housing S and to determine if the terminal fittings 40 are accommodated in the correct sub-housing S.

Figure 34:
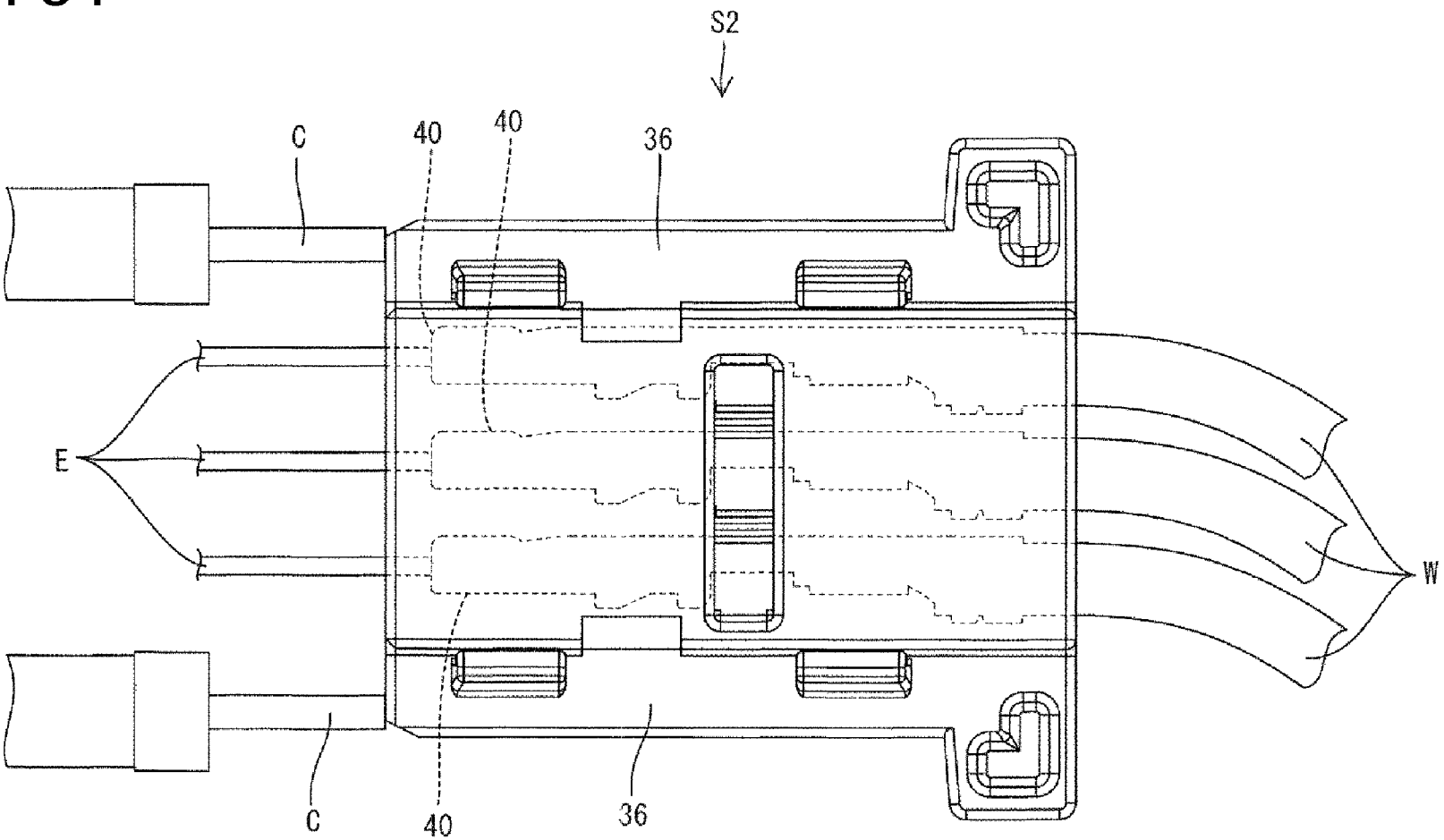
FIG. 34 is a diagram showing a state where an electrical connection test is conducted for the second sub-housing.

As shown in FIG. 34, no cutout 36A is formed at the front ends of the guide pieces 36 in the second sub-housing S2. Thus, the contact probes C contact the front ends of both guide pieces 36 and detection signals are sent to the controller.

Figure 35:
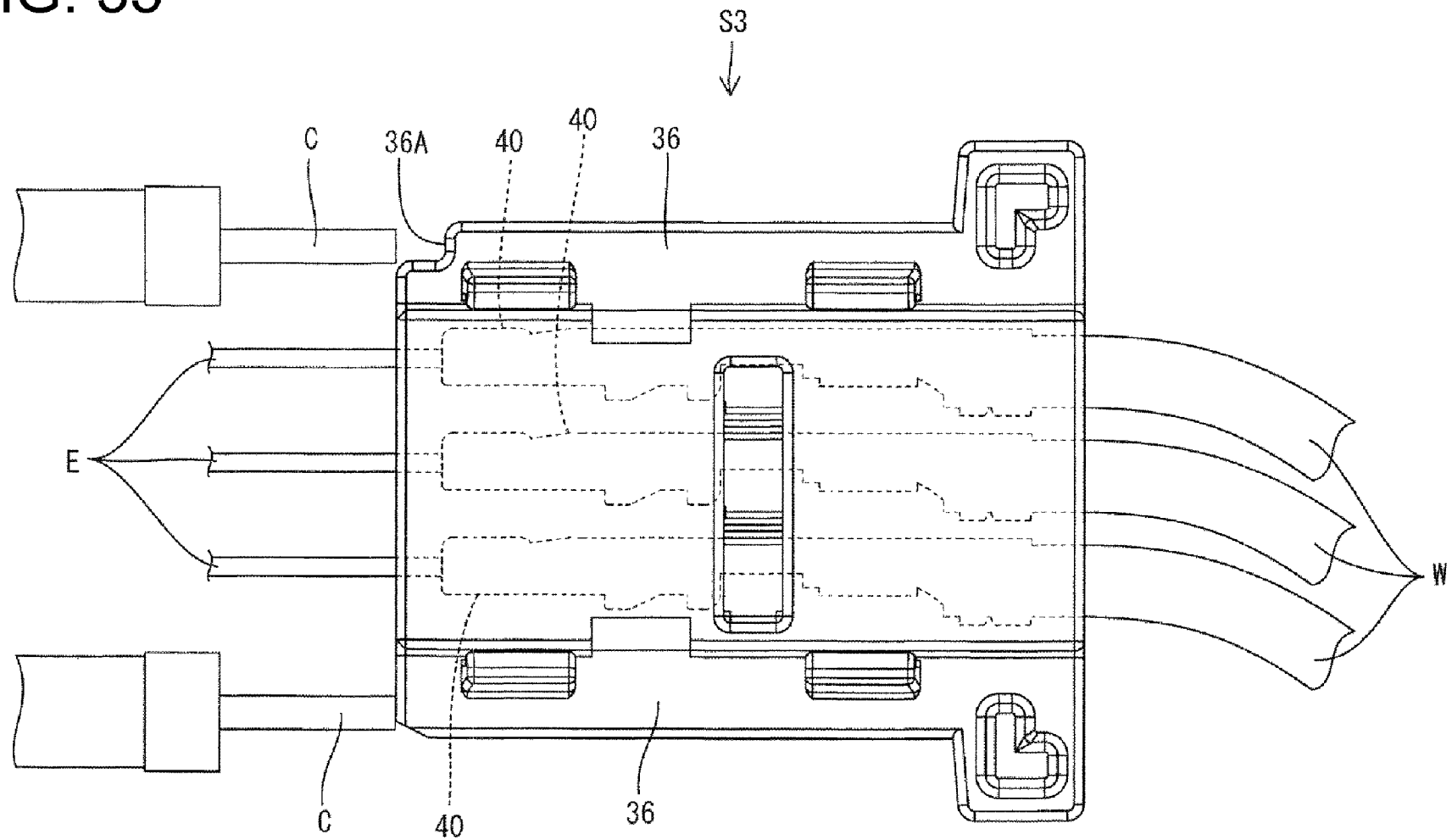
FIG. 35 is a diagram showing a state where an electrical connection test is conducted for the third sub-housing.

As shown in FIG. 35, the cutout 36A is formed only in the upper guide piece 36 in the third sub-housing S3. Thus, the upper contact probe C does not contact the surrounding wall where the cutout A is formed. However, the lower contact probe C contacts the front end of the guide piece 36 and a detection signal is sent to the controller.

Figure 36:
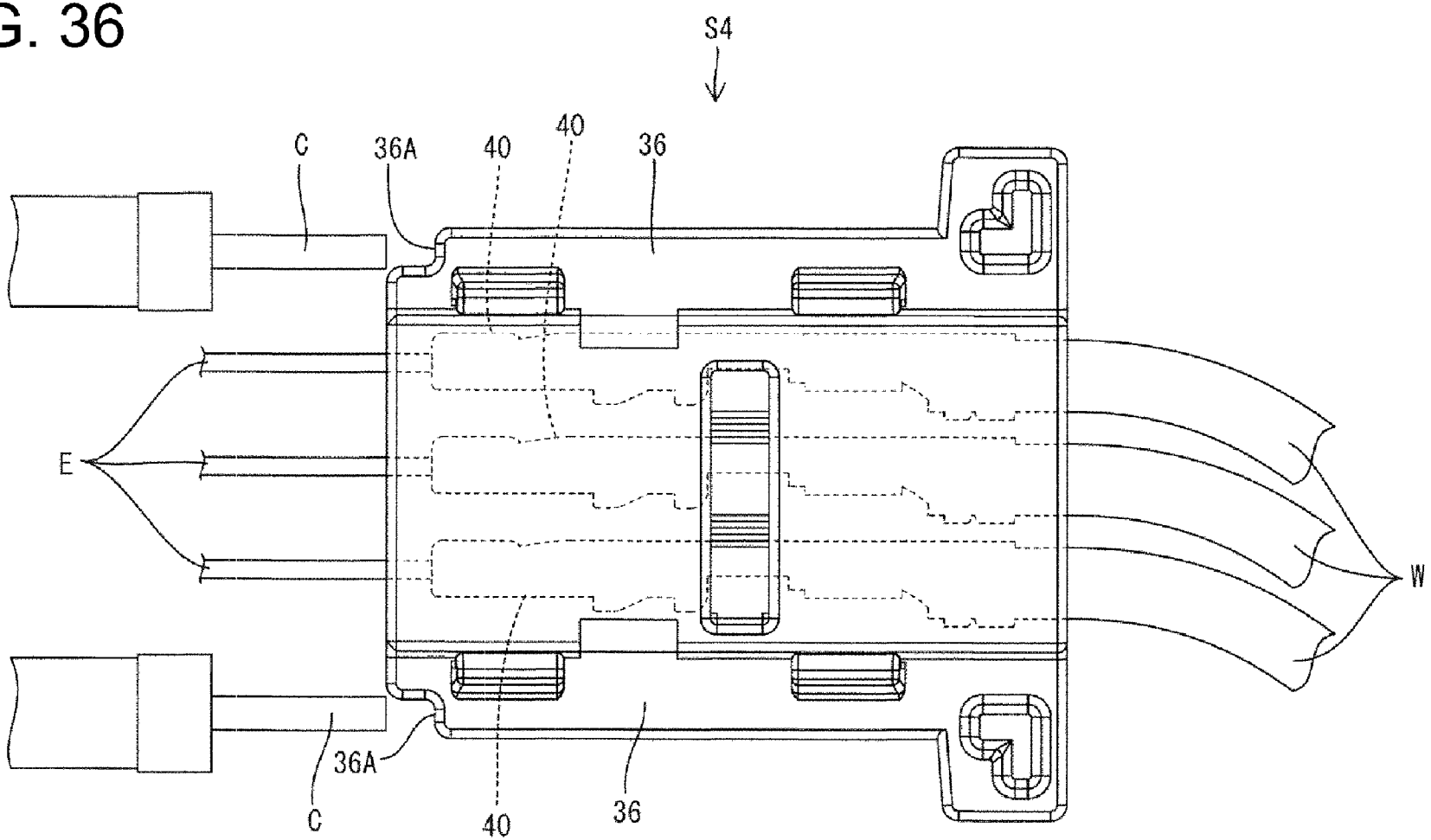
FIG. 36 is a diagram showing a state where an electrical connection test is conducted for the fourth sub-housing.

As shown in FIG. 36, the cutouts 36A are formed in the front ends of both guide pieces 36 in the fourth sub-housing S4. Thus, neither contact probe C contacts the surrounding wall where the cutouts 36A are formed.

Figure 37:
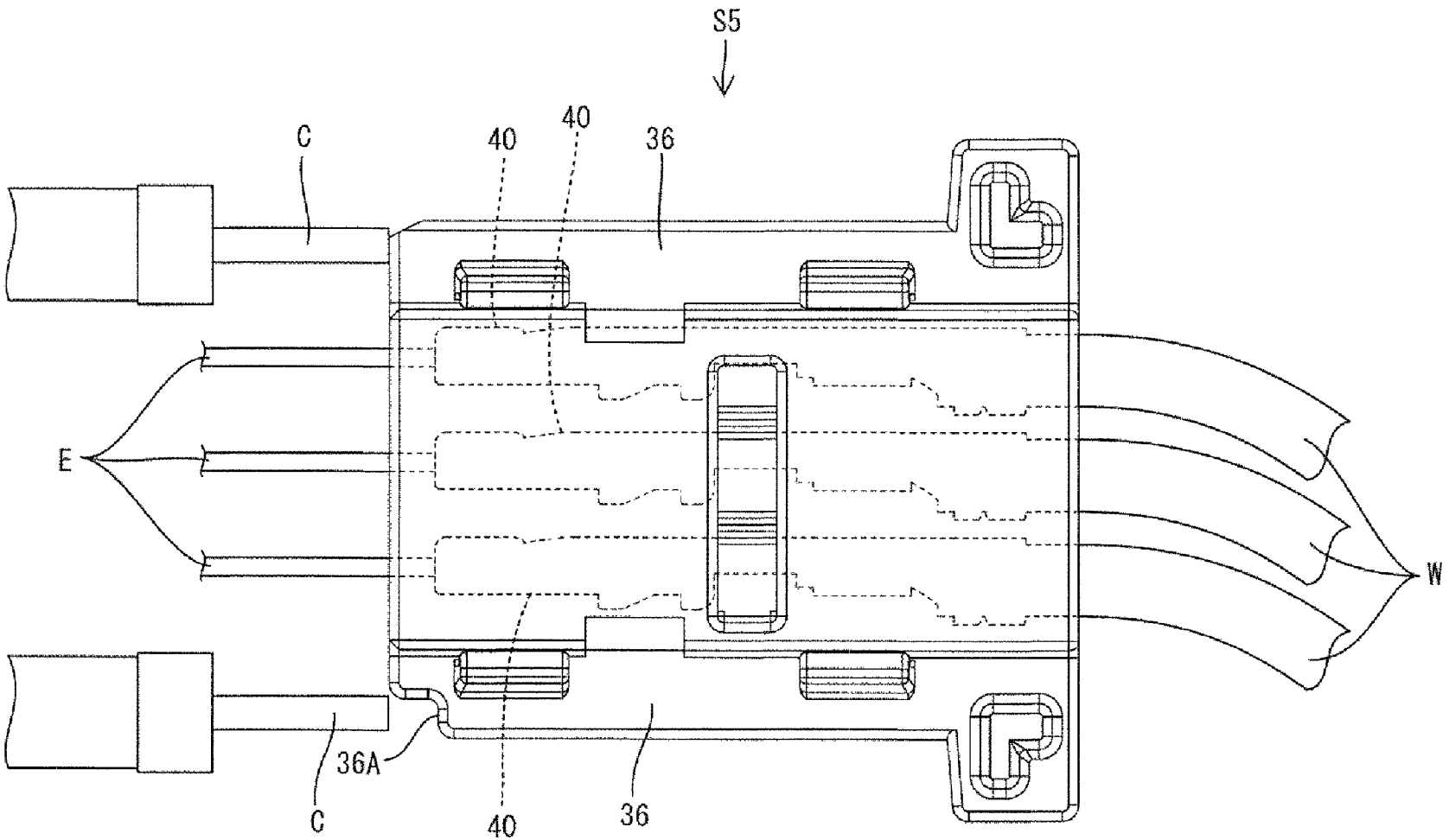
FIG. 37 is a diagram showing a state where an electrical connection test is conducted for the fifth sub-housing.

As shown in FIG. 37, the cutout 36A is formed only in the lower guide piece 36 in the fifth sub-housing S5. Thus, the lower contact probe C does not contact the surrounding wall where the cutout 36A is formed, but the upper contact probe C contacts the front end of the guide piece 36 and a detection signal is sent to the controller.

The controller includes storage means (not shown) for storing the presence or absence and position of the cutout 36A and the type of the sub-housing S in correspondence and judging means (not shown) for judging whether the sub-housing is a correct one by referring to the storage means. Thus, an electrical connection test can determine whether the terminal fittings 40 are connected with the correct wiring harness W by the conducting probes E and to inspect whether the terminal fittings 40 are accommodated in the proper sub-housing S by the contact probes C. An electrical connection test for the sixth sub-housing S6 is carried out without using the contact probes C.

Terminal fittings 40 connected with the wiring harness W are inserted into the respective cavities 32. Electrical connection tests then are conducted separately or in parallel for the second to sixth sub-housings S2 to S6 before the buildup. More particularly, each sub-housing S2 to S6 is mounted in the mounting portion of the inspection apparatus and the operation lever is operated. Thus, the inspection unit approaches the sub-housing S mounted in the mounting portion and the conducting probes E contact the front ends of the respective terminal fittings 40 to determine whether the terminal fittings 40 are connected with the correct wiring harness W. Simultaneously, the contact probes C to determine the presence or absence of the cutout 36A, and whether the terminal fittings 40 are accommodated in the correct sub-housing S is judged by referring to the storage means.

The sub-housings S are built up after the electrical connection tests are completed for all of the sub-housings S2 to S6. For example, the respective first identifying projections A1 are accommodated in the first identifying recesses B1 to permit the buildup of the sub-housings S1, S2. At this time, the retainers 35 of the first sub-housing S1 enter the cavities 32 through the retainer insertion opening 34 of the second sub-housing S2. The respective sub-housings S1, S2 are held at proper positions by the contact of the ribs 35A with the opening edge of the retainer insertion opening 34.

The resilient locking pieces 37 deform out in the width direction during the build up operation. However, the locking claws 37A move over the engaging portions 38 when the sub-housings S1, S2 are connected properly. Thus, locking pieces 37 restore resiliently so that the locking claws 37A engage the engaging portions 38 to hold the sub-housings S in a built-up state.

The joint connector 10 is inserted into the fitting recess 22 of the intermediate connector 20 after the respective sub-housings S have been built up properly. At this time, the guide pieces 36 enter the corresponding guide grooves 27 to guide the connecting operation of the two connectors 10, 20. The lock arm 12 deforms down and in during this connection. However, the lock arm 12 restores resiliently when the lock 12D aligns with the lock hole 25 so that the lock 12D engages the inner peripheral surface of the lock hole 25. In this way, the joint connector 10 and the intermediate connector 20 are held together with the terminal fittings 40 of the joint connector 10 and the intermediate terminals 24 of the intermediate connector 20 connected electrically. The other joint connector 10 is built up in the same manner, and the wiring harnesses W connected with the terminal fittings 40 of both joint connectors 10 are connected electrically with each other.

The guide pieces 36 are used to identify the type of sub-housing S. Thus, it is possible to determine whether the terminal fittings 40 are in the correct sub-housing S and in the correct arrangement in the electrical connection test conducted before the building-up operation. Accordingly, the wiring harness W can be laid correctly after the buildup of the sub-housings S.

The presence or absence of the cutouts 36A in the front ends of the guide pieces can be detected easily by employing the contact probes C as contact sensors.

The detectable portions are provided only on the second to fifth sub-housings S2 to S5 to conduct the inspection by the contact probes C. Thus, the inspection can be more efficient.

Figure 38:
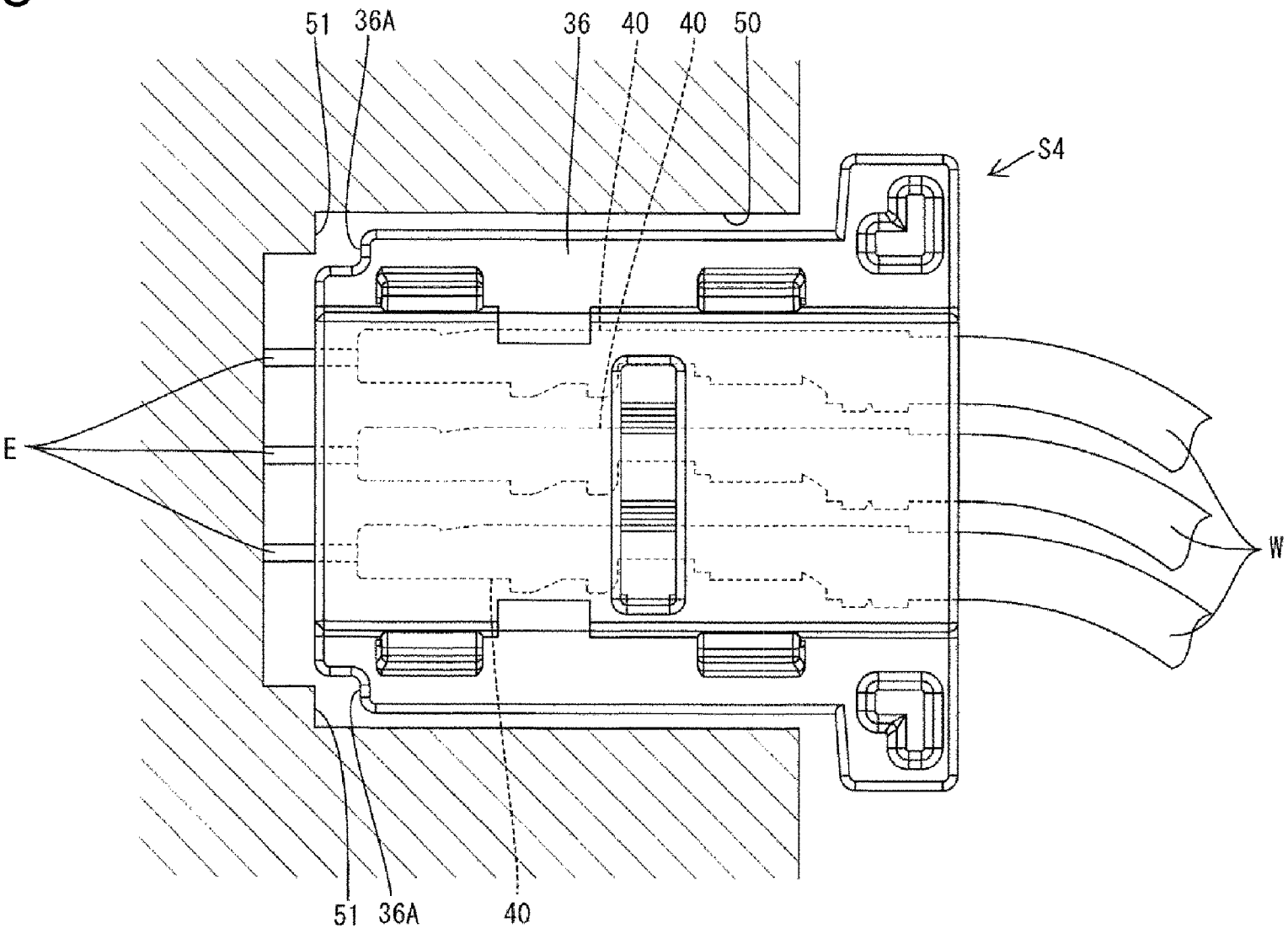
FIG. 38 is a diagram showing a state where an electrical connection test is conducted for the fourth sub-housing in a further embodiment.

A further embodiment of the invention is described with reference to FIG. 38. An inspection apparatus of this embodiment is constructed to detect detectable portions of sub-housings S by their shapes and/or arrangements. For example, the inspection apparatus includes a housing accommodating portion 50 for the fourth sub-housing S4 and two projections are provided on the back wall of the housing accommodating portion 50 in conformity with the cutouts 36A. An operator knows that the sub-housing being inspected is the fourth sub-housing S4 if the sub-housing can be pushed to the back end of the housing accommodating portion 50. On the other hand, the guide pieces 36 interfere with the projections 51 if a sub-housing S other than the fourth sub-housing S4 is urged into this housing accommodating portion 50. Hence the sub-housing cannot be pushed to the back end of the housing accommodating portion 50 and an operator knows that this sub-housing is not the fourth sub-housing S4.

The invention is not limited to the above described and illustrated embodiments. For example, the following embodiments are also embraced by the technical scope of the present invention as defined by the claims.

Although the contact probes C and the projections 51 are used as detectors in the above embodiments, noncontact sensors may be used as detectors according to the present invention.

Although the presence or absence of the cutouts 36A is detected in the first embodiment, each sub-housing S may have cutouts 36A of a different shape and/or position and detectors fittable into such cutouts 36A may be provided for each sub-housing S.

Although the type of the sub-housing S is inspected only for the sub-housings S2 to S5 located at intermediate positions in the above embodiments, it may be inspected for all the sub-housings S1 to S6 according to the present invention.

Although the detectors are provided in the inspection apparatus in this embodiment, they may be provided separately from the inspection apparatus according to the present invention.

What is claimed is:

1. A joint connector comprising:

at least, first second and third sub-housings that can be built up in a plurality of levels along a build-up direction; and projecting pieces projecting from the sub-housings in a direction intersecting the build-up direction, each projecting piece having opposite first and second mating surfaces facing in the build-up direction, at least one identifying projection provided on each of the first mating surfaces and identifying recesses provided on each of the second mating surfaces, the identifying projection on the first sub-housing being configured differently from the identifying projection on the second sub-housing, the identifying recess on the second sub-housing being configured to receive the identifying projection on the first sub-housing, the identifying recess on the third sub-housing being configured differently from the identifying recess on the second sub-housing, the identifying recess on the third sub-housing further being configured so that the identifying projection of the second sub-housing can be inserted therein while the identifying projection of the first sub-housing interferes with opening edges of the identifying recess in the third sub-housing for preventing insertion, so that the identifying recesses receive the identifying projections only if the sub-housings are built up in a specified order.

2. The joint connector of claim 1, wherein the sub-housings have opposite front and rear ends, the projecting pieces being at the rear ends of the sub-housings and substantially aligning with one another when the sub-housings are built up to define a hand-push portion, and wherein as the front ends of the built up sub-housings are fittable into a mating housing by pushing the hand-push portion towards the mating housing.

3. The joint connector of claim 1, wherein two projecting pieces are on each sub-housing, each of the projecting pieces have one of the identifying projections and one of the identifying recesses, a spacing between the identifying projections on the first sub-housings being different than a spacing between the identifying projections on the second sub-housings so that the identifying projections are received in the identifying recesses only if the sub-housings are built up properly.

4. The joint connector of claim 1, wherein the identifying recesses provided in the sub-housing in a bottommost level is disposed and configured to receive the identifying projections on all of the sub-housings above the bottommost level therein.

5. The joint connector of claim 1, wherein each of the sub-housings has at least one cutout formed therein, the cutout in on the first sub-housings having a different shape or position than the cutout in the second sub-housings to enable identification of each of the sub-housings by the shape or position of the cutout.

6. The joint connector of claim 1 further comprising:

cavities formed in the sub-housings for accommodating terminal fittings therein;

a retainer insertion opening formed in a first mating surface of at least the first sub-housings and communicating with at least one of the cavities;

a retainer projecting from a second mating surface of at least the second sub-housings and insertable through the retainer insertion opening and into the cavity of the first sub-housing to retain the terminal fitting therein; and ribs provided projecting from at least one of the retainer insertion openings and the retainers for preventing the built-up sub-housings from being displaced in directions substantially parallel to the mating surfaces.

7. The joint connector of claim 6, wherein the sub-housing located at one end in a build-up direction of the sub-housings includes a lock arm for holding a mating housing.

8. The joint connector of claim 6, wherein the ribs are formed at the base ends of the retainers, the ribs contacting opening edges of the retainer insertion openings as the retainers are inserted into the retainer insertion openings, and specified clearances are set over the substantially entire an periphery between the opening edges of the retainer insertion openings and the retainers before the ribs contact the opening edges of the retainer insertion openings.

9. The joint connector of claim 8, wherein each of the ribs includes a slanted guide surface for guiding the sub-housing towards a proper position by sliding in contact with the opening edge of the retainer insertion opening and a holding portion extending substantially in a build-up direction from the slanted guide surface for contacting the opening edge of the retainer insertion opening and holding the sub-housing substantially at a proper position.

10. The joint connector of claim 6, wherein each of the sub-housings has at least one cutout formed therein, the cutout in a first of the sub-housings having a different shape or position than the cutout in a second of the sub-housings to enable identification of each of the sub-housings by the shape or position of the cutout.

11. The joint connector of claim 10, wherein the cutouts are provided in each of the sub-housings located at intermediate positions and excluding the sub-housings located at opposite ends in a build-up direction.

* * * * *